US005878387A

United States Patent [19]

Oshikiri et al.

[11] Patent Number: 5,878,387

[45] Date of Patent: Mar. 2, 1999

[54] CODING APPARATUS HAVING ADAPTIVE CODING AT DIFFERENT BIT RATES AND PITCH EMPHASIS

[75] Inventors: Masahiro Oshikiri, Urayasu; Kimio Miseki, Kawasaki; Masami Akamine, Yokosuka; Tadashi Amada, Kawasaki, all of Japan

[73] Assignee: Kabushiki Kaisha Toshiba, Kawasaki, Japan

[21] Appl. No.: 537,276

[22] Filed: Sep. 29, 1995

[30] Foreign Application Priority Data

Mar. 23, 1995 [JP] Japan ..... 7-063660

[51] Int. Cl.[6] ..... G10L 5/04

[52] U.S. Cl. ..... 704/207; 704/209; 704/221; 704/216; 704/219

[58] Field of Search ..... 395/2.1, 2.12, 395/2.16, 2.18, 2.19, 2.2, 2.25, 2.28, 2.29, 2.31, 2.3

[56] References Cited

U.S. PATENT DOCUMENTS

| | | | |
|---|---|---|---|
| 4,672,669 | 6/1987 | Desblache et al. . | |
| 5,142,584 | 8/1992 | Ozawa | 395/2.32 |
| 5,159,611 | 10/1992 | Tomita et al. . | |
| 5,173,941 | 12/1992 | Yip et al. | 395/2.26 |
| 5,179,594 | 1/1993 | Yip et al. | 395/2.26 |
| 5,187,745 | 2/1993 | Yip et al. | 395/2.28 |
| 5,199,076 | 3/1993 | Tanaguchi et al. | 395/2.16 |
| 5,265,190 | 11/1993 | Yip et al. | 395/2.28 |
| 5,371,853 | 12/1994 | Kao et al. | 395/2.32 |
| 5,396,576 | 3/1995 | Miki et al. | 395/2.31 |
| 5,414,796 | 5/1995 | Jacobs et al. | 395/2.3 |
| 5,457,783 | 10/1995 | Chhatwal et al. | 395/2.8 |

FOREIGN PATENT DOCUMENTS

| | | |
|---|---|---|
| 0 514 912 | 11/1992 | European Pat. Off. . |
| 0 516 439 | 12/1992 | European Pat. Off. . |
| 0 545 386 | 6/1993 | European Pat. Off. . |

OTHER PUBLICATIONS

Proc. of the ICASSP, 1986, pp. 473–476, Joseph P. Campbell, Jr., et al. "Voiced/Unvoiced Classification of Speech With Applications to the U.S. Government LPC–10E Algorithm".

*Primary Examiner*—David R. Hudspeth
*Assistant Examiner*—Vijay B. Chawan
*Attorney, Agent, or Firm*—Oblon, Spivak, McClelland, Maier & Neustadt, P.C.

[57] ABSTRACT

The coding apparatus comprises an adaptive codebook storing excitation signals as vectors, a synthesis filter for forming a synthesis signal, referring to the vectors stored in the adaptive codebook, a similarity computation circuit for computing a similarity between the synthesis signal obtained by the synthesis filter and a target signal, and a coding scheme determining circuit for deciding one coding scheme from a plurality of coding schemes respectively having coding bit rates different from each other, on the basis of the similarity obtained by the similarity computation circuit.

13 Claims, 27 Drawing Sheets

CODING APPARATUS HAVING ADAPTIVE CODING AT DIFFERENT BIT RATES AND PITCH EMPHASIS

BACKGROUND OF THE INVENTION

1. Field of the Invention

The present invention relates to a coding apparatus for coding speech signals or the likes at a high efficiency, and particularly, to a coding apparatus suitable for variable rate coding.

2. Description of the Related Art

Coding of speech signals at a high efficiency and a low bit rate is an important technique for effective use of electric waves and reduction communication costs in the field of communication using movable devices such as car telephones and the likes and domestic communication in a company. In recent years, a variable rate communication system using a code division multiple access (CDMA) method has been planned in the United States of America, and expects for multiple channels and high quality services which make the best use of the characteristics of a variable rate have increased. In addition, the variable rate speech coding is a method which realizes effective use of stored media, since effective bit distribution can be achieved by variable rate speech coding, from view points of application of stored systems, in accordance with the characteristics of speech. On this background, studies and developments in the variable rate speech coding have been actively made.

With respect to a fixed rate, a CELP (Code Excited Linear Prediction) method has been known as a speech coding scheme capable of high quality speech synthesis at a bit rate of 8 kbps or less. However, the CELP method is a main trend in the field of a variable rate. In this case, among a plurality of types, e.g., four types of coding bit rates, one bit rate is selected for every fixed frame length, and coding is performed by the CELP method optimized to comply with the selected bit rate. In addition, where the coding bit rate is as low as 1 kbps, a vocoder system using a random noise scheme for a drive signal is adopted in some cases, and generally, a different coding scheme is used for every one bit rate. In variable rate coding, the superiority of the method is decided, depending on how the average bit rate can be decreased, while achieving target quality, and therefore, a method for selecting a coding scheme for every frame is significant. With respect to this demand, following two methods have been proposed in prior art techniques.

As a first method, for example, there is a QCELP method by A. Dejaco et al (reference 1: "QCELP: The North American CDMA Digital Celtular Variable Rate Speech Coding Standard", Proc. of the IEEE Workshop on Speech Coding for Telecommunications, PP5, 6, Oct., 1993). This method adopts a system in which a frame power is extracted as a characteristic amount, and an encoder is selected on the basis of the characteristic amount. In addition, a VRPS method by E. Paksoy et al (reference 2: "Variable Rate Speech Coding with Phonetic Segmentation", Proc. ICASSP 93, PPI I-155 158, April 1993) adopts a system in which an encoder is selected on the basis of the weighting sum value of seven characteristic amounts including a low frequency speech energy, a zero-cross ratio, and the likes.

Although the coding system select methods as described above attain a merit that the methods can be realized by relatively less calculation amounts, decoded speech does not always achieve target quality defined by SNR or the like, but sometimes results in low quality. Further, on condition that background noise is added to an input signal, extraction of characteristic amounts cannot be properly carried out, so that proper selection results are not sometimes appropriate. This sometimes leads to deterioration in quality of synthesized voices.

As a second method, there is an FS-CELP (Finite State-CELP) method (reference 3: "Finite State CELP for variable rate speech coding", IEE Proc.-I, vol. 138, No. 6, PP603–610, Dec. 1991).

Although the encoder select method of this reference attains a merit in that an encoder is selected such that target quality is achieved, all the encoders previously prepared must be carried out, so that there is a problem in that the calculation amount is extremely large.

In addition, a hybrid method combining the first and second methods as described above is reported by L. Cellario et al. (reference 4: "Variable Rate Speech Coding for UMTS", Proc. of the IEEE Workshop on Speech Coding for Telecommunications, PPI-2, Oct. 1993). In this hybrid method, firstly, encoders are restricted by using characteristic amounts obtained by analyzing an input voice, and secondly, the encoders thus limited respectively perform coding, thereby to finally select an encoder which minimizes the cost function. Although an intermediate solution between the first and second methods can be obtained in this method, a plurality of encoders must be operated, and therefore, there remains a problem in that the calculation amounts become large.

As has been described above, in the one of the conventional methods in which an input signal is analyzed to extract a characteristic amount and an encoder is selected in accordance with the characteristic amount, a decoded voice does not always attain target quality and sometimes results in degradation in quality. In case where an input signal is added with background noise, extraction of characteristic amounts cannot be properly achieved, so that a proper encoder cannot be selected, thereby resulting in degradation in quality of synthesized voices. The other method in which all the prepared encoders are used to perform coding to select the encoder which minimizes the cost function and the hybrid method combining the former two methods led to a problem that the calculation amount is extremely large.

In addition, in conventional CELP coding, if the quantization bit rate is decreased, the number of quantization bits is decreased, making it difficult to express changes in pitch period and pitch waveform. In addition, since pitch information is greatly damaged in a coding step, the degree of recovery of the pitch information is limited even if recovery processing of pitch information is performed with use of a post filter in the decoding side.

Further, if coded data transferred with a transfer path code added is directly stored or transferred without changes, redundant bits relating to a transfer path code completely unnecessary for storing or transferring of the data are stored or transferred together, so that there is a problem that efficiency in use of a storing apparatus or a transfer path is decreased.

Furthermore, there is a problem that compression coding data which is unnecessary for transfer or storage is stored, depending on the method of compression coding of data and the specifications of a reproducing apparatus, and therefore, efficiencies in use of a recording medium and a transfer path are decreased.

Further, unnecessary coding data such as transfer path codes and compression codes as described above is decoded for every reproduction of data, the circuit scale of a reproducing apparatus and power consumption is increased.

SUMMARY OF THE INVENTION

The present invention has an object of providing a coding apparatus which realizes selection of a coding scheme capable of attaining target quality with a small average rate, at a small calculation amount.

According to the present invention, there is provided a coding apparatus which comprises an adaptive codebook storing a plurality of reference vectors, a synthesis filter for forming a synthesis signal from the reference vector stored in the adaptive codebook, a similarity calculator for calculating a similarity between the synthesis vector and an input signal, a coding scheme determining circuit for determining one code scheme from among a plurality of code schemes of different coding bit rates which are prepared, using the similarity obtained by the similarity calculator, and a coder for coding the input signal in accordance with the determined coding scheme.

In the present invention, a reference vector is extracted from an adaptive codebook and is filtered by the synthesize filter from which a synthesize signal is generated, and the similarity between the synthesize signal and a target signal is calculated. A coding scheme is determined on the basis of the similarity. In general, an adaptive codebook is a component forming a coding apparatus of a CELP method, and has a feature that a redundant degree of a target signal repeated in a pitch period can be efficiently expressed, so that a target signal can be represented at a high accuracy by a vector of a drive signal stored in the adaptive codebook when a target signal is a signal of an intensive cyclic characteristic. Therefore, when a target signal is a signal of an intensive cyclic characteristic, target quality can be easily attained even if the bit number assigned to a drive signal of the synthetic filter is reduced. In brief, the coding bit rate can be lowered. Inversely, when a target signal is of a signal having a weak cyclic characteristic, this signal cannot be represented accurately only by an adaptive codebook. Therefore, the target quality cannot be attained unless the coding bit rate is high.

Therefore, the similarity in synthesize voice levels between a reference vector read out from an adaptive codebook and a target vector is obtained, and a coding scheme of a low bit rate is selected when the similarity is high while a coding scheme of a high bit rate is selected when the similarity is low. In this manner, it is possible to realize selection of an adaptive coding scheme having a low average bit rate and capable of attaining target quality.

Specifically, in a method in which a characteristic amount is extracted by analyzing a target signal and a coding scheme is selected, depending on the size and change amount of the characteristic amount, there is a problem that a large number of frames which do not attain target quality are generated. However, in the present invention, an adaptive codebook as a component forming the coding apparatus is used to select a coding scheme on the basis of a similarity in synthesize voice levels, and therefore, target quality can be attained in almost all of frames.

Meanwhile, in the method in which coding is performed by using all of a plurality of encoders previously provided and an encoder which minimizes the cost function, there is a problem that the calculation amount is extremely large. However, in the present invention, only retrieving of an adaptive codebook is required even in case where the calculation amount for deciding a reference vector inputted into a synthesize filter is relatively large, and the calculation amount for selecting a coding scheme is remarkably small. In addition, if a reference vector is determined and a coding scheme is selected by analyzing the pitch of a target signal, the calculation amount is much smaller than that required in case of performing retrieving of an adaptive codebook. Further, if a reference vector is determined by the pitch information of a preceding frame and a coding scheme is selected, an increase in the calculation amount is substantially unnecessary.

Thus, according to the present invention, it is possible to select a coding scheme which decreases an average rate with a small calculation amount and is capable of attaining target quality.

In addition, the present invention has an object of providing a coding apparatus such that sufficient pitch information can be obtained in the coding side which in order to attain sufficiently high synthesize voice quality in the decoding side.

According to the present invention, there is provided a coding apparatus comprising a pitch analyzer for analyzing an input signal in a pitch to obtain a pitch period and pitch gain, an emphasis circuit for emphasizing the input signal, using the pitch period and pitch gain.

Further, the present invention has an object of providing an apparatus for storing and transferring coded data which improves a use efficiency of a recording medium and a transfer path, while restricting enlargement in circuit scale of a reproducing apparatus, and which can reduce electric power consumption.

According to the present invention, there is provided an apparatus for storing and transferring which comprises a receiver for receiving coded data to which transmission code is appended, a data processor for decoding the code including the transmission code unnecessary for transferring data to delete it, and attending codes including error correction code necessary for storing and transferring data to the received code data to form compressed coded data, and storing and transferring section for storing and transferring the compressed coded data.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

In the following, embodiments of the present invention will be explained with reference to the drawings.

Figure 1:
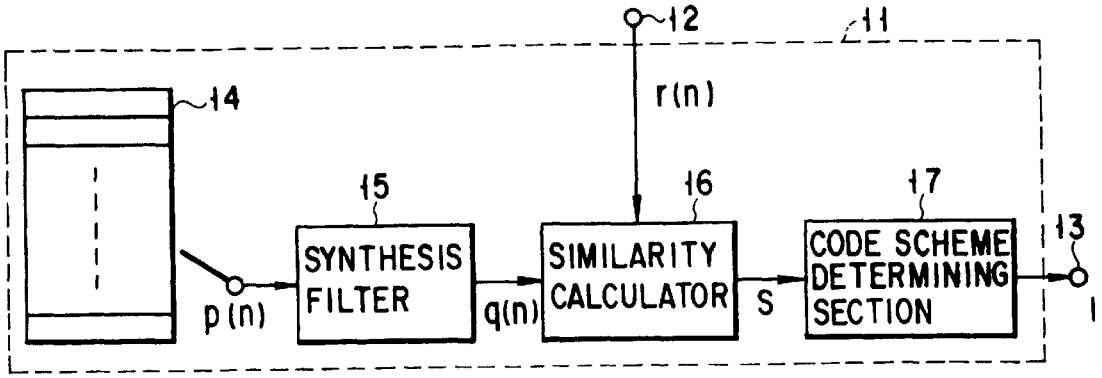
FIG. 1 is a block diagram of a coding apparatus using an adaptive codebook according to a first embodiment of the present invention.

FIG. 1 is a block diagram showing the structure of a coding scheme selection section 11 according to a first embodiment of the present invention. The coding scheme selection section 11 determines a coding scheme to be selected, on the basis of a target signal r(n) inputted via an input terminal 12, and outputs coding scheme selection information I through an output terminal 13. The selection section 11 comprises an adaptive codebook 14, a synthesis filter 15, a similarity calculator 16, and a coding scheme determining section 17.

In the following description, the procedure for selecting a coding scheme in this embodiment will be explained. However, in this embodiment, two coding schemes are used to simplify the explanation. The value of the coding scheme selection information is "1" or "2". A coding scheme having a low bit rate is selected when I="1" is satisfied, and a coding scheme having a high bit rate is selected when I="2" is satisfied.

At first, a target signal r(n) is inputted through an input terminal 12. Next, a vector p(n) is referred to from an adaptive codebook 14, and a synthesis signal q(n) is generated from the vector p(n), by means of a synthesis filter 105. As an example, operation of the synthesis filter 15 can be expressed by the following equation (1) with respect to a z-conversion area.

$$Hw(Z) = \frac{1}{1 + \sum_{i=1}^{10} \alpha_1 \gamma^i Z^{-1}} \tag{1}$$

Here, {α}10i=1 represents an LPC (linear prediction analysis) coefficient, and γ is a constant which is greater than 0 and is equal to or smaller than 1.0. Therefore, the relationship between a synthesis signal q(n) and a reference vector p(n) is expressed by a time area, as expressed in the following equation (2).

$$q(n) = p(n) - \sum_{i=1}^{10} \alpha i \gamma i q(n-i) \tag{2}$$

Next, the similarity between a target signal r(n) and a synthesis signal q(n) is calculated in the similarity calculator 16. Specifically, as will be described below, in the similarity calculator 16, an SNR value for a signal obtained by multiplying a synthesis signal q(n) by an optimum gain g and for a target signal is outputted as a similarity u. Firstly, a square error value E between a signal obtained by multiplying a synthesis signal q(n) by an optimum gain g and a target signal r(n) is defined as will be expressed in the following equation (3).

$$E = \Sigma(r(n) - g \cdot q(n))2 \tag{3}$$

The optimum gain g is a value obtained when E is minimized, and therefore, E is subjected to partial differentiation and then solved with respect to g. As a result, the optimum gain g is expressed as in the following equation (4)

$$g = \frac{\Sigma r(n) q(n)}{\Sigma q2(n)} \tag{4}$$

The SNR value S is expressed as in the following equation (5), where the above optimum gain g is used.

$$\begin{aligned} S &= 10 \log_{10}\left( \Sigma r^2(n) / \Sigma \left( r(n) - \frac{\Sigma r(n) q(n)}{\Sigma q^2(n)} q(n) \right)^2 \right) \\ &= 10 \log_{10}(1 - (\Sigma r(n) q(n))^2 / (\Sigma r^2(n) \cdot \Sigma q^2(n)) \end{aligned} \tag{5}$$

Next, the coding scheme determining section 17 determines which coding scheme to use, by using the SNR value S. The selection method is executed so as to satisfy the following equations, with use of a threshold value A, and coding scheme selection information I is outputted.

$$\begin{aligned} &I=1 \text{ where } S \geqq A \\ &I=2 \text{ where } S < A \end{aligned} \tag{6}$$

Figure 2:
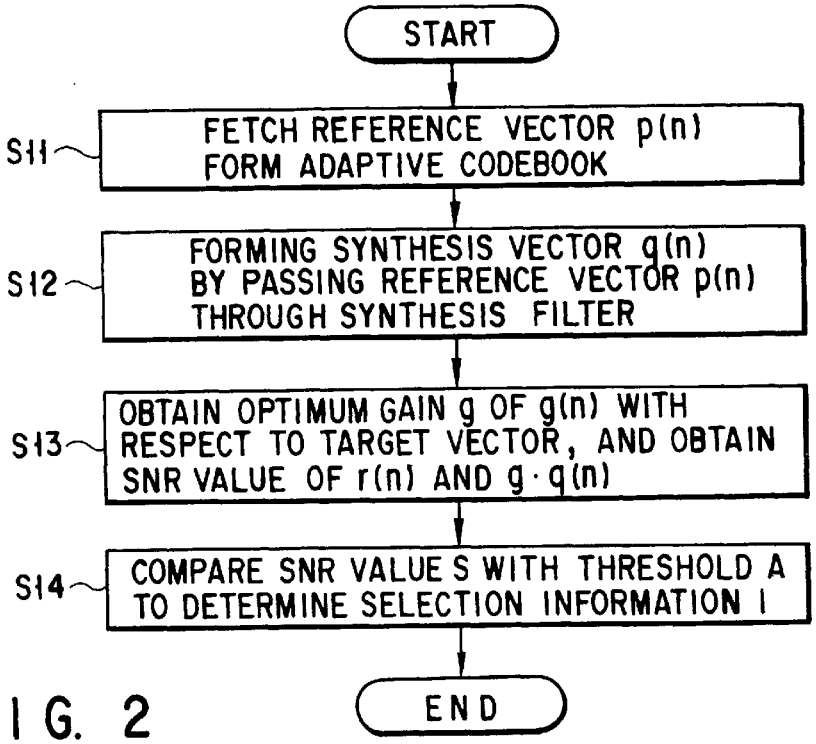
FIG. 2 is a flow-chart for explaining processing procedures of the same embodiment.

The above flow is summarized in FIG. 2. At first, a reference vector p(n) is extracted from an adaptive codebook 14 in a step S11, and then, the vector p(n) is passed through a synthesis filter 15, to prepare a synthesis vector q(n). Next, an optimum gain g to be supplied to a synthesis vector q(n) is obtained in a step S13, and further, an SNR value S for r(n) and g·q(n) is obtained. At last, in a step S14, the SNR value S and the threshold value A are compared with each other, to determine coding scheme selection information I for selecting a low bit rate coding scheme or a high bit rate coding scheme, for example. The information I is outputted through an output terminal 13.

Figure 3:
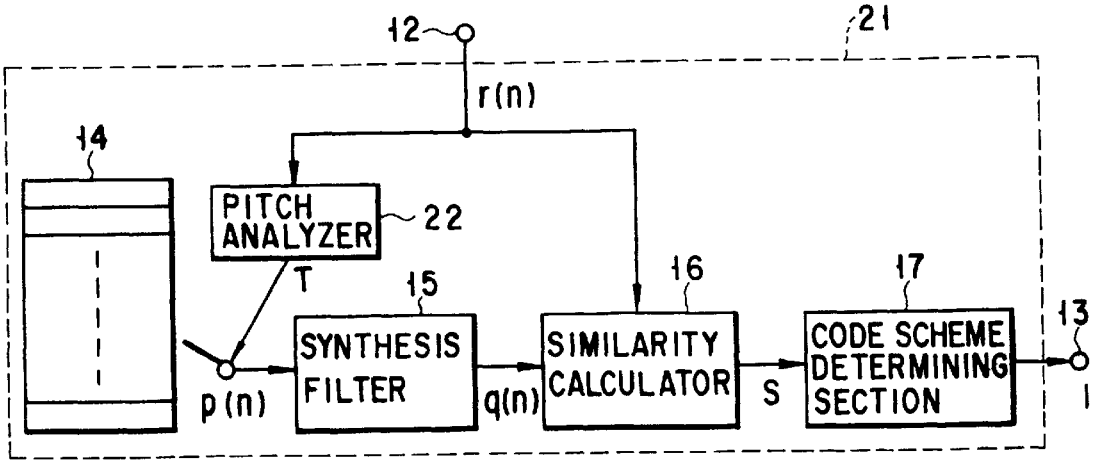
FIG. 3 is a block diagram of a coding apparatus using a pitch analysis according to a second embodiment of the present invention.

FIG. 3 is a block diagram showing the structure of a coding scheme selection section 21 according to a second embodiment of the present invention. In the following explanation, those components of FIG. 3 which have the same functions as those of FIG. 1 will be referred to by the same reference symbols. This coding scheme selection section 21 is different from that of FIG. 1 in that a target signal r(n) is analyzed by a pitch analyzer 22 to obtain a pitch T, and this pitch T is used to determine a vector p(n) to be referred to from an adaptive codebook 14. Therefore, the pitch analyzer 22 will be explained in the following explanation.

The pitch analyzer 22 uses a past signal r(n−T) which precedes by a time T sample to predict a target signal r(n), and outputs T which minimizes the power E of a prediction error signal of the prediction, as a pitch period. Specifically, the prediction error signal power E is expressed as follows.

$$E = \sum_{h=1}^{N} (a(n) - g \cdot a(n-T))^2 \tag{7}$$

Here, g denotes a pitch gain and N denotes a pitch analysis length. To obtain a stable pitch period, a pitch analysis length of, e.g., N=256 is preferable. The equation (1) is partially differentiated, and the prediction error signal power E has a minimum when the value becomes 0. The equation is solved as follows.

$$E = \sum_{n=1}^{N} r^2(n) - \frac{\sum_{n=1}^{N} r(n) r(n-T)^2}{\sum_{n=1}^{N} r^2(n-T)} \tag{8}$$

Here, the value of T which minimizes the equation (8) expresses the pitch period. The first term in the right side of the equation (8) is a constant, and therefore, a pitch period T which maximizes the second term in the right side of the equation is searched for in actual procedures. In other words, the pitch analyzer calculates the right side of the equation (8) as the pitch period is changed, and outputs the pitch period obtained when the right side of the equation (8) indicates a maximum value. The pitch period T thus obtained is used to extract a reference vector p(n) from the adaptive codebook 14.

Figure 4:
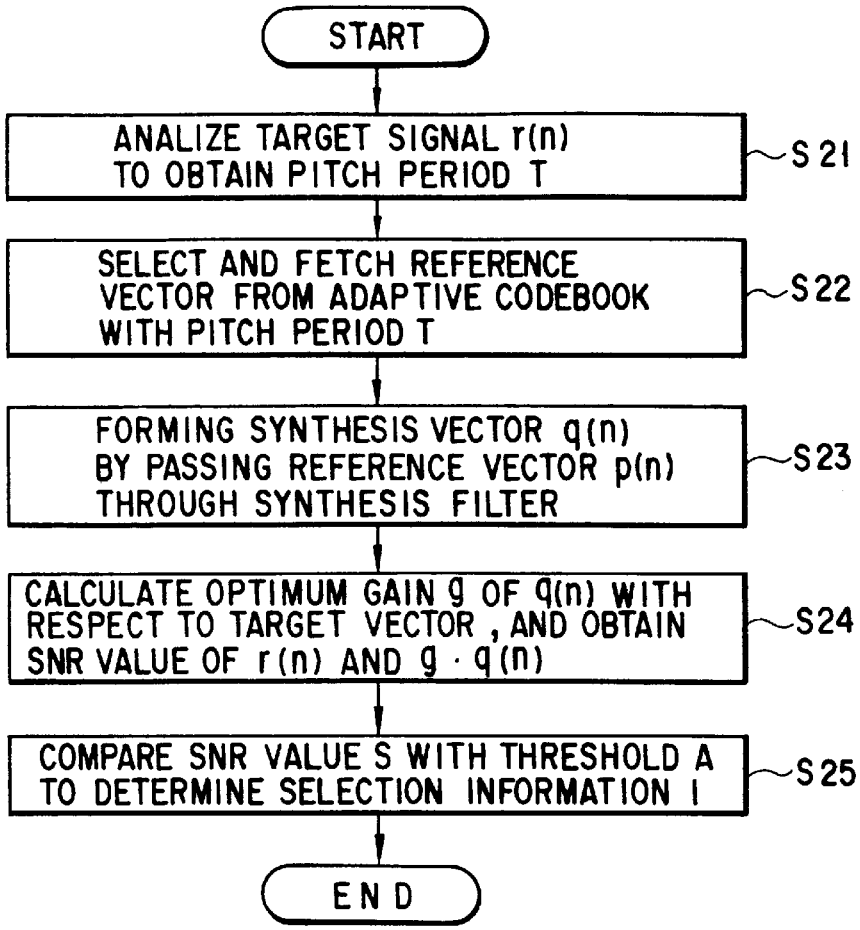
FIG. 4 is a flow-chart for explaining processing procedures of the same embodiment.

The above flow is summarized in FIG. 4. At first, a target signal r(n) is analyzed by the pitch analyzer 22 to obtain a pitch period T, in a step S21. Next, a vector p(n) to be referred to is extracted with use of the pitch period T, in a step 522. In other words, the adaptive codebook 14 is searched for the reference vector p(n) corresponding to the pitch period T thus obtained. The processing performed in the following steps S23, S24, and S25 are respectively the same as that performed in the steps S12, S13, and S14 in FIG. 2, and therefore, explanation thereof will be omitted.

In this embodiment, although it has been explained that the pitch period T is obtained by using target signal r(n), more suitable pitch analysis can be achieved by using of an input speech signal u(n) when the target signal r(n) is weighted by a hearing weighting filter. In addition, since envelope information 0 of a speech signal can be removed by using a prediction remaining difference signal v(n) obtained by making an input speech signal u(n) pass through an LPC prediction filter, much excellent pitch analysis can be achieved. Accordingly, in this embodiment, an input speech signal u(n) or a prediction remaining difference signal v(n) can be used in place of a target signal r(n). Further, in this embodiment, although explanation has been made to a case where a primary pitch prediction filter is used in the pitch analyzer 22, a prediction filter of a higher order may be used.

Figure 5:
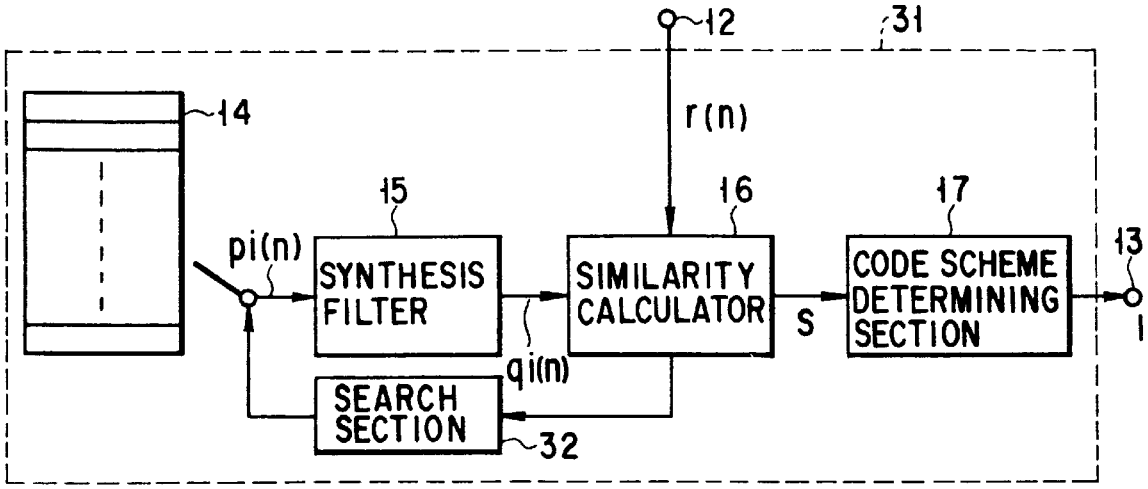
FIG. 5 is a block diagram of a coding apparatus searching for all the reference vectors of a codebook, according to a third embodiment of the present invention.

FIG. 5 is a block diagram showing the structure of a coding scheme selection section 31 according to a third embodiment of the present invention. In the following explanation, those components of FIG. 5 which have the same functions as those of FIG. 1 will be referred to by the same reference symbols. This coding scheme selection section 31 is different from the selection section of the first embodiment in that all the vectors in the adaptive codebook 14 are used as candidates, synthesis vectors are respectively obtained with respect to the reference vectors by the synthesis filter 15, and the synthesis vector most similar to the target vector r(n) is searched by a search section 32. Therefore, the following explanation will be made to the search section 32.

The search section 32 searches all the vectors stored in the adaptive codebook 14, as reference vectors, and makes the similarity calculator 16 calculate an SNR value S. Further, the search section 32 uses the value of S obtained when this value is maximized, to determine a coding scheme by means of the coding scheme determining section 17, and outputs coding scheme selection information I.

However, in general cases, it is not always necessary to obtain the SNR value for search, but it is only necessary to search a reference vector which minimizes the square error value E defined by the equation (3). In this case, the SNR value is calculated after the reference vector which minimizes the square error value E is obtained, and the calculated SNR value is outputted to the code scheme determining section 17.

Figure 6:
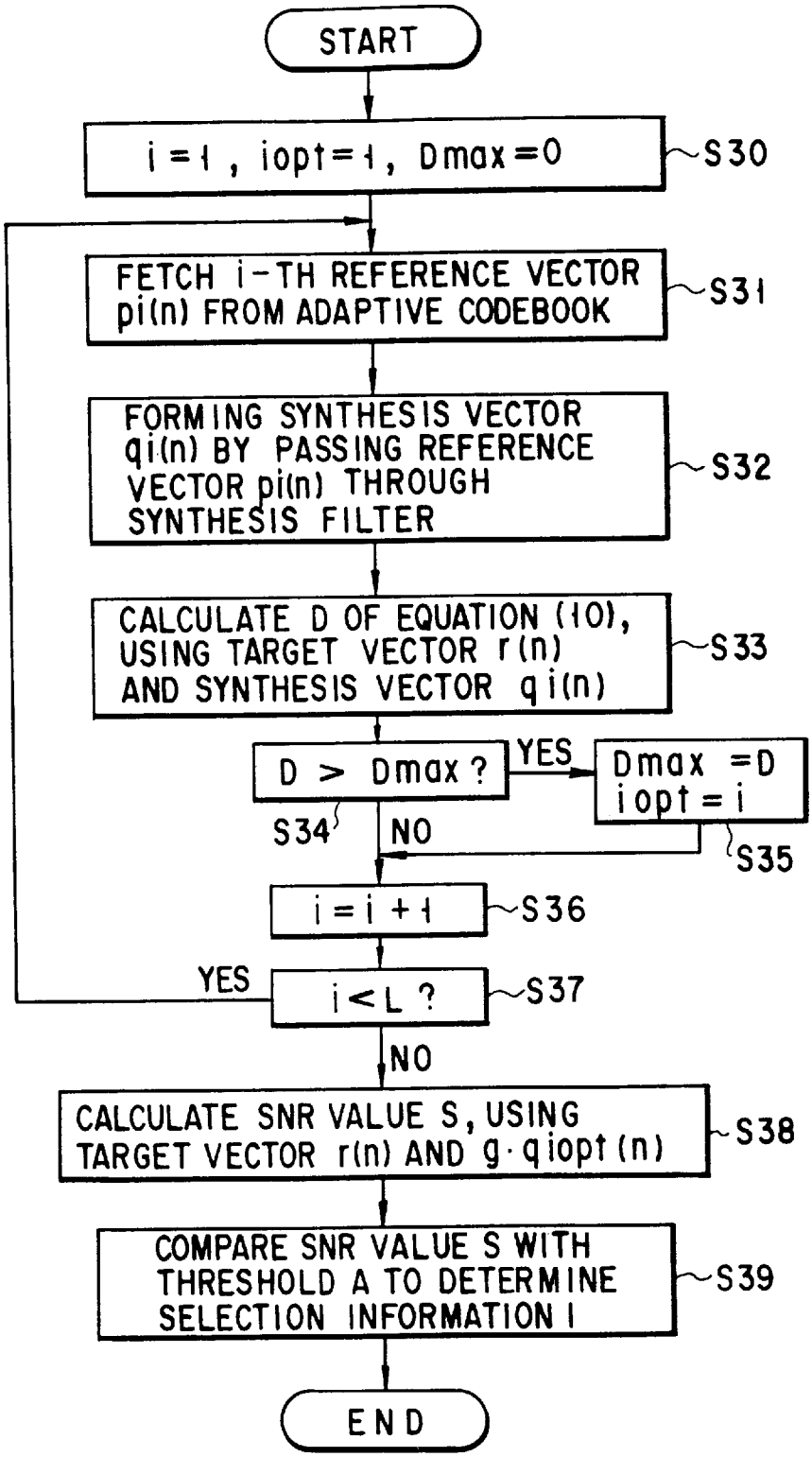
FIG. 6 is a flow-chart for explaining processing procedures of the same embodiment.

The above flow is summarized in FIG. 6. Here, L denotes the number of vectors stored in the adaptive codebook 14. Further, an optimum gain g expressed by the equation (4) is substituted in the equation (3), and then, this equation (3) is developed as follows.

$$E = \Sigma r^2(n) - \frac{(\Sigma r(n)q(n))^2}{\Sigma q^2(n)} \tag{9}$$

When the square error value E is a minimized value, the first term in the right side of the equation (9) is obtained as a dependence degree as follows.

$$D = \frac{(\Sigma r(n)q(n))^2}{\Sigma q^2(n)} \tag{10}$$

Then, the reference vector which maximizes the dependence degree is searched.

At first, parameters are set such that i=1, iopt=1, and Dmax=0 are satisfied, in a step S30. In the next, a synthesis vector qi(n) is obtained through steps S31 and S32. Note that the steps S31 and S32 are the same as the steps S11 and S12 shown in FIG. 2, and therefore, explanation thereof will be omitted. Then, in step S33 the dependence degree D is obtained from a target vector r(n) and a synthesis vector qi(n) in accordance with the equation (10). Further, the sizes of the dependence degree D and the maximum dependence degree Dmax are compared with each other, in a step S34. Here, if the dependence degree D is greater than the maximum dependence degree Dmax, the value of the Dmax is updated to the same value as the degree D, in a step S35, and the value of i in this time point is stored into the iopt. Then, the processing goes to a step S36. If the dependence degree D is smaller than the maximum degree Dmax, the processing directly goes to the step S36, and the value of i is increased by 1, in the step S36. Further, the value of i is compared with the number L of vectors included in the adaptive codebook 14. Here, if the value of i is smaller than L, the processing returns to the step S31, and the flow of processing as described above is repeated. If the value of i is greater than L, the flow of the processing escapes from this loop, and goes to a step S38. In the step S38, an SNR value for a target vector r(n) and g·qiopt(n) is obtained, and in a step S39, coding scheme selection information I is outputted on the basis of the obtained SNR value S. The details of the steps S38 and S39 are the same as those of the steps S13 and S14 in FIG. 2, and therefore, explanation thereof will be omitted therefrom.

According to this embodiment, a reference vector which becomes a maximum SNR value can be obtained from all the vectors stored in an adaptive codebook 14. Therefore, there is an advantage in that the actual efficiency of the adaptive codebook 14 can be correctly evaluated without influences on the precision and accuracy of the pitch obtained by pitch analysis with respect to an input speech including particularly large background noise, unlike in the second embodiment.

Although it has been explained that a reference vector is obtained from all the vectors in the adaptive codebook 14 in the above embodiment, it is possible to search a certain restricted number of reference vectors as candidates.

Figure 7:
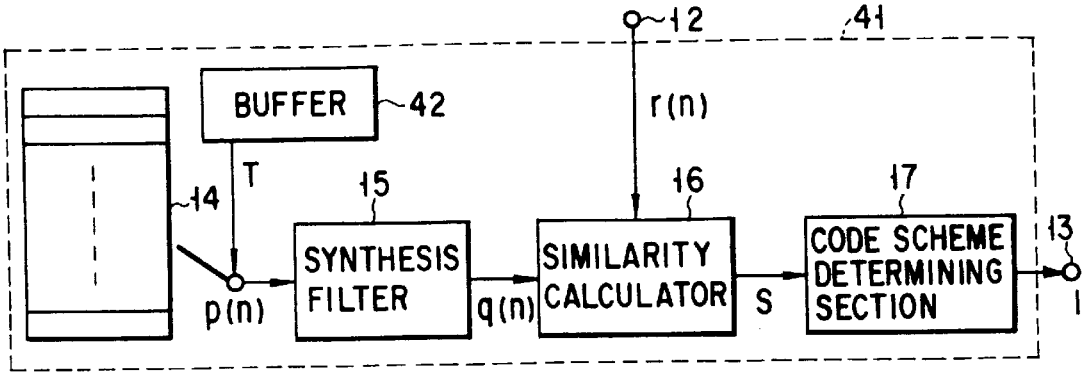
FIG. 7 is a block diagram of a coding apparatus using a prediction signal according to a fourth embodiment of the present invention.

FIG. 7 is a block diagram showing the structure of a coding scheme selection section 41 according to a fourth embodiment of the present invention. In the following explanation, those components of FIG. 7 which have the same functions as those of FIG. 1 will be referred to by the same reference symbols. The coding scheme selection section 41 of FIG. 7 is different from that of the first embodiment in that the selection section 41 uses pitch information-obtained for coding of a previous frame, for a current frame, and a vector p(n) to be referred to from the adaptive codebook 14 is determined on the basis of the pitch information for the previous frame. Specifically, this embodiment is additionally provided with a buffer 42, and pitch information obtained for a previous frame is stored in the buffer 42. This pitch information represents a result of searching the adaptive codebook 14 obtained when coding is performed for a previous frame, i.e., a pitch determined by searching the adaptive codebook 14 when coding is performed for a previous frame.

Then, in accordance with the pitch information stored in the buffer 42, a reference vector p(n) is extracted from an adaptive codebook 14, and coding scheme selection information I is outputted through a synthesis filter 15, a similarity calculator 16, and a coding scheme determining section 17 on the basis of the reference vector p(n). The processing performed by the synthesis filter 15, the similarity calculator 16, and the coding scheme determining section 17 are respectively the same as that performed by the corresponding components of the first embodiment, and therefore, explanation thereof will be omitted.

Figure 8:
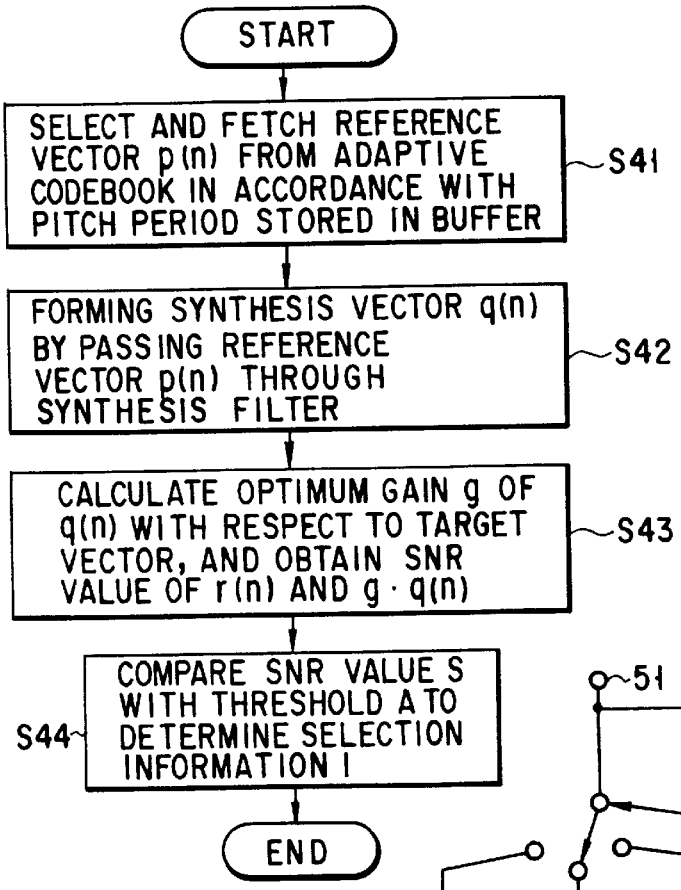
FIG. 8 is a flow-chart for explaining processing procedures of the same embodiment.

The above flow of processing is summarized in FIG. 8. At first, a reference vector p(n) is selected and extracted from the adaptive codebook 14 with use of the pitch period T stored in the buffer 42, in a step S41. The processing of following steps S42, S43, and S44 are respectively the same as that of the steps S12, S13, and S14 in FIG. 2.

Thus, in this embodiment, since a reference vector is determined with use of pitch information of a previous frame, there is an advantage in that calculation for deciding a reference vector, such as, pitch analysis according to the second embodiment and search of the adaptive codebook 14 according to the third embodiment are not particularly required, but coding scheme selection information I can be obtained with a much less calculation amount.

Figure 9:
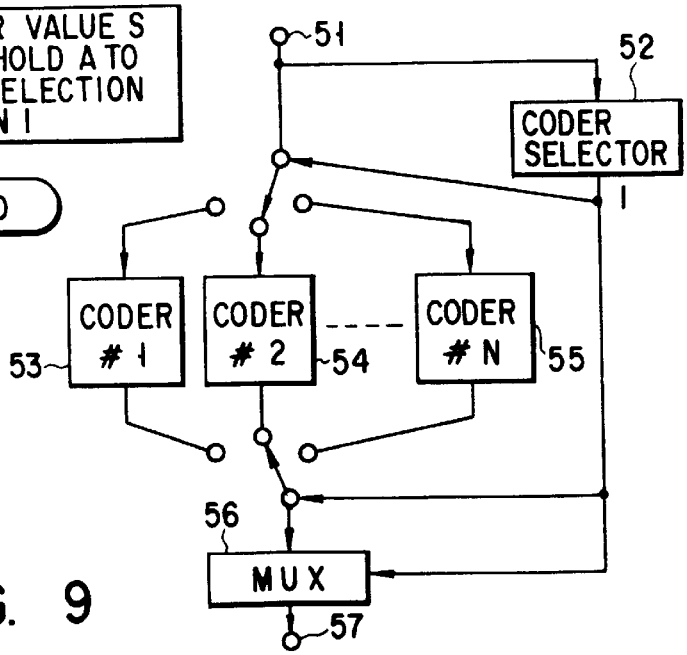
FIG. 9 is a block diagram of a speech coding apparatus providing with a plurality of coders, according to a fifth embodiment of the present invention.

In the next, explanation will be made to an embodiment which adopts the above-mentioned coding scheme selection section to a speech coding apparatus, as a fifth embodiment. FIG. 9 is a block diagram showing the structure of a speech coding apparatus according to this embodiment, and the coding scheme selection section 52 adopts one of the structures of the coding scheme selection sections 11, 21, 31, and 41 explained with reference to the first to fourth embodiments. Encoders 53 to 55 respectively have coding schemes different from each other, in other words, different bit rates, and one of them is selected by the coding scheme selection section 52.

In the following, operation of this embodiment will be explained. At first, a target signal is inputted from an input terminal 51. This target signal may be of a signal which has been passed through a hearing weighting filter and on which influences from a previous frame have been reduced, in several cases. Those portions which relate to the processing are omitted from this figure, to simplify the explanation. The target signal is inputted into the coding scheme selection section 52 and coding scheme selection information I is outputted. On the basis of the coding scheme selection information I, one of the encoders 53 to 55 is selected, and the target signal is inputted into the selected encoder, thereby performing coding. Upon completion of the coding, coding parameters obtained as coding results and coding scheme selection information I are inputted into a multiplexer 56, and converted into a bit stream. Thereafter, the bit stream is outputted through an output terminal 57.

In this embodiment, explanation will be made to more specific examples of a speech encoding apparatus, e.g., in which a CELP method encoder is used as a high bit rate encoder and in which a random drive type LPC vocoder (which will be referred to as an LPC vocoder hereinafter) is used as a low bit rate encoder.

Figure 10:
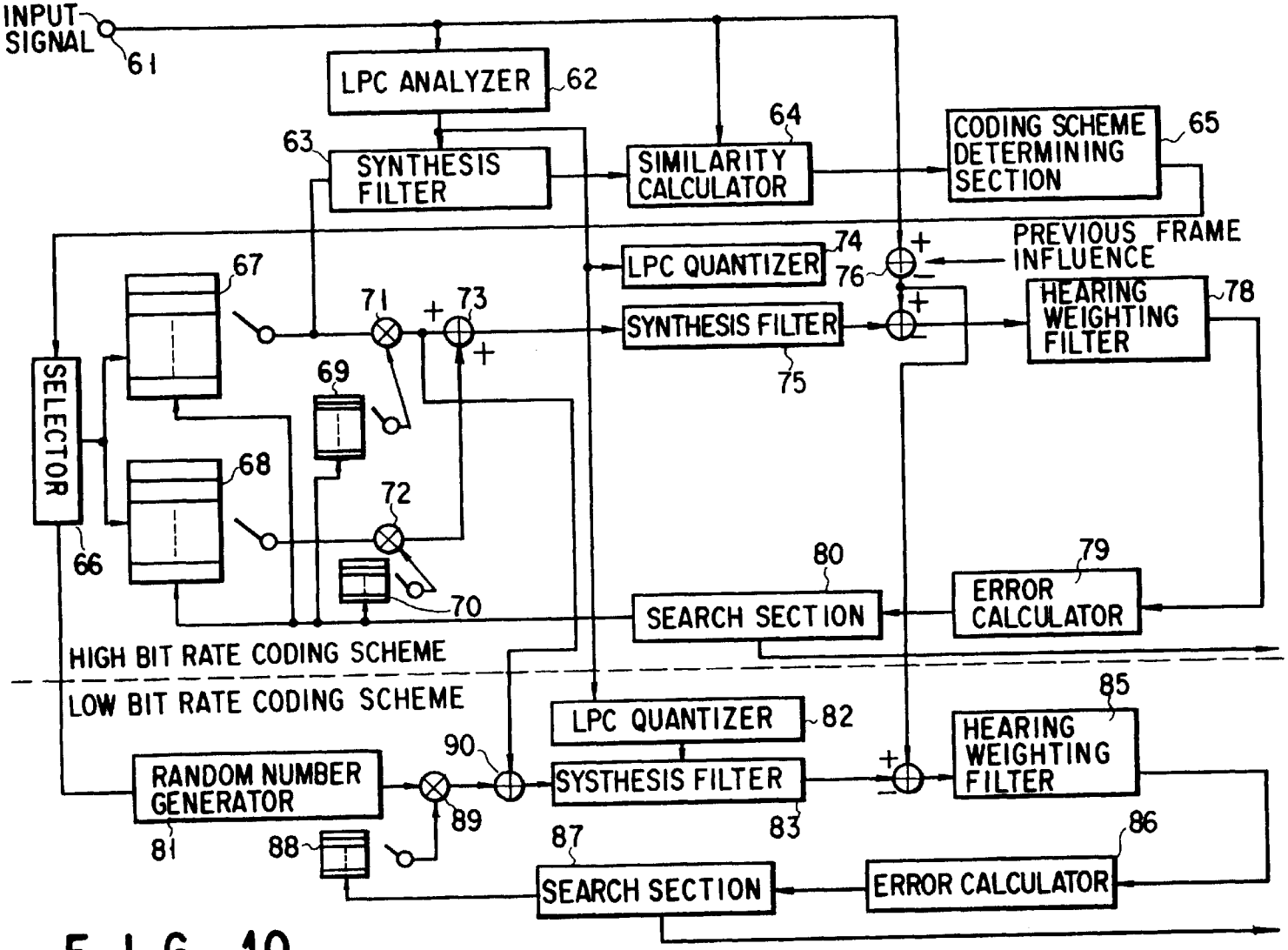
FIG. 10 is a block diagram of a speech coding apparatus capable of selecting coding schemes, according to a sixth embodiment of the present invention.

FIG. 10 is a block diagram of a speech coding apparatus according to this embodiment. In the CELP method, parameters to be transmitted as an output signal to a decoder are: (1) an adaptive vector index of an adaptive codebook 67; (2) a noise vector index of a noise vector codebook 68; (3) a pitch gain index of a pitch gain codebook 69; (4) a noise gain index of a noise gain codebook 70; and (5) an LPC index obtained as a result of quantization by an LPC quantizer 74.

Parameters to be transmitted as an output signal by the LPC vocoder to the decoder are: (1) a gain index of adaptive gain codebook 88; (2) an LPC index obtained as a result of quantization by an LPC quantizer 82; (3) an adaptive vector index of an adaptive codebook 67; and (4) a pitch gain index of a pitch gain codebook 69.

Here, since an LPC vocoder uses a random value as a drive signal, information of the drive signal need not be transmitted to the decoder, and therefore, the coding bit rate can be set to an extremely small value. In addition, in many cases, an LPC quantizer 82 and an adaptive gain codebook 88 of a low bit rate are prepared for an LPC vocoder, and therefore, the bit rates can totally be set to be small.

In the following, operation of the speech coding apparatus of this embodiment will be explained. A speech signal inputted through an input terminal 61 is subjected to LPC analysis by an LPC analyzer 62, and a linear prediction coefficient (which will be referred to as an LPC coefficient, hereinafter) is obtained thereby. A synthesis filter 63 whose characteristic is defined by the LPC coefficient is inputted with an adaptive vector obtained from an adaptive codebook 67, thereby to obtain a synthesis signal. The similarity between the synthesis signal and the inputted speech signal is calculated by a similarity calculator 64, and on the basis of the calculation result, a coding scheme is determined by a code scheme determining section 65.

Then, a CELP method type encoder as a high bit rate encoder or an LPC vocoder as a low bit rate encoder is selected by a selector 66, in correspondence with coding scheme selection information outputted from the code scheme determining section 65.

The following explanation will be made to a case where an encoder of the CELP method is selected by the selector 66. Note that an encoder of the CELP method is indicated in FIG. 10 above the broken line.

An adaptive vector obtained from an adaptive codebook 67 and a noise vector obtained from a noise codebook 68 are respectively multiplied by a pitch gain obtained from a pitch gain codebook 69 and a noise gain obtained from a noise gain codebook 70, by multipliers 71 and 72. An adaptive vector and a noise vector after multiplication by the pitch and noise gains are added to each other by an adder 73, thereby to generate a drive signal for a synthesis filter 75.

Meanwhile, the characteristic of the synthesis filter 75 is defined on the basis of an LPC coefficient obtained by quantizing an LPC coefficient, which is obtained by the LPC analyzer 62, by the LPC quantizer 74, and a drive signal outputted from an adder 73 is inputted into the synthesis filter 75, thereby generating a synthesis signal. When a target signal is a signal from which influences of a previous frame have been reduced this synthesis signal is subtracted by a subtracter 77 from the target signal corresponding to the input signal, to obtain an error signal.

The error signal is weighted by a hearing weighting filter 78, and thereafter, the electric power of the signal is obtained by an error calculator 79. A combination of an adaptive vector, a noise vector, a pitch gain, and a noise gain which minimizes the error signal power is searched for from an adaptive codebook 67, a noise codebook 68, a pitch gain codebook 69, and a noise gain codebook 70. The adaptive vector, noise vector, pitch gain and the noise gain which minimizes the error signal power and which are obtained as a result of the search are respectively expressed as an adaptive vector index, a noise vector index, a pitch gain index, and a noise gain index. These adaptive vector index, noise index, pitch gain index, and noise gain index, and an LPC index representing an LPC coefficient are outputted as coding parameters to a transmission medium or a storage medium not shown, and further transmitted to a speech decoding apparatus not shown.

The next explanation will be made of a case where an LPC vocoder is selected by the selector 66. Note that an LPC vocoder is indicated in FIG. 10 below the broken line.

The LPC vocoder first searches and decides an index of an adaptive codebook 67 and a pitch gain of a pitch gain codebook 69.

A random value vector which has an average value C and a dispersion value I is generated by a random value generator 81. This random value vector is multiplied by a gain in a multiplier 89, and is added with an adaptive vector from a multiplier 71 after multiplication by a pitch gain, thereby generating a drive signal for a synthesis filter 83. Then, an LPC coefficient is quantized by an LPC quantizer 82, and the characteristic of a synthesis filter 83 is defined on the basis of the LPC coefficient after the quantization. A drive signal outputted from the multiplier 89 is applied to the synthesis filter 83, and a synthesis signal is thereby generated. This synthesis signal is subtracted from a target signal by a subtracter 84, and an error signal is thereby obtained.

The error signal is weighted by a hearing weighting filter 85, and thereafter, the electric power is obtained by an error calculator 86. A gain which minimizes the error signal power is obtained from an adaptive gain codebook 88 by a search section 87. In this case, the gain can be obtained by means of analysis, not by searching. A gain index representing the gain which minimizes the error signal power and an LPC index representing an LPC coefficient are outputted as coding parameters, to a transmission medium or a storage medium not shown, and are then transmitted to a speech coding apparatus not shown.

Also, as has been explained in the fifth embodiment, coding scheme selection information I obtained by the code scheme determining section 65 is converted together with coding parameters into a bit stream by a multiplexer not shown, and is outputted to a transmission medium or a storage medium.

In this embodiment, the adaptive codebook 67 as a component of an encoder of the CELP method and a synthesis filter 63 are used for selection of an encoder (or coding scheme), and therefore, it is possible to select a proper coding scheme by using code scheme determining sections as explained above in the first to fourth embodiments.

Specifically, when an input speech signal as a target signal in this case is a signal having an intensive periodicity, the target signal can be expressed with a high accuracy by a vector of a drive signal stored in the adaptive codebook 67. Therefore, even if the number of bits assigned to a drive signal for the synthesis filter is reduced to be small, it is possible to easily attain target quality and to use an LPC vocoder having a low coding bit rate, as long as a target signal has an intensive periodicity. On the contrary, when a target signal has a weak periodicity, the target signal cannot be expressed with a high accuracy, only by the adaptive codebook 67. Therefore, in this case, it is possible to attain target quality by using an encoder of a CELP method having a high coding bit rate.

Further, in this embodiment, it is possible to easily attain target quality while lowering the average bit rate, by making an arrangement that uses the similarity calculator 64 to obtain the similarity between a synthesis signal obtained by making a reference vector obtained from the adaptive codebook 67 pass through the synthesis filter 75 and an input speech signal as a target signal, as has been explained in the first to fourth embodiments, and that a low bit rate encoder is selected when the similarity is large while a high bit rate encoder is selected when the similarity is small.

Meanwhile, although the structure of a speech decoding device is not shown in the drawings, a decoder of a CELP method and an LPC vocoder method are provided so as to correspond to the speech coding apparatus shown in FIG. 10. In accordance with coding scheme selection information from the speech coding apparatus, one of these decoders is selected, and an original speech signal is decoded in accordance with coding parameters from the speech coding apparatus, by the selected decoder.

As has been explained above, the basis of the present invention is that one of a plurality of prepared coding schemes is selected, depending on how accurately an adaptive codebook can express a target signal. Therefore, according to the present invention, it is possible to provide a coding apparatus which enables selection of a coding scheme capable of achieving a low average rate and target quality, while reducing the calculation amount required for the selection.

Now, a speech coding apparatus according to another embodiment will be explained.

Figure 11:
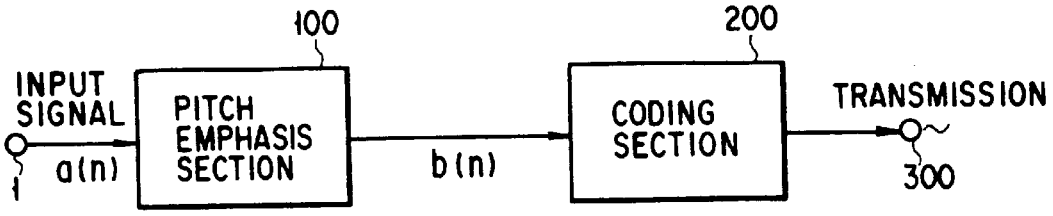
FIG. 11 is a block diagram of a coding apparatus providing a pitch emphasis section according to a seventh embodiment of the present invention.

FIG. 11 is a schematic block circuit of a speech coding apparatus according to a seventh embodiment of the present invention.

According to this embodiment, an input signal a(n) inputted through an input terminal 1 is subjected to pitch emphasis in the pitch emphasis section 100, and is thereafter encoded by a coding section 200. The encoded signal is transmitted through an output terminal 300. This means, a pitch emphasis section 100 performs pitch analysis of an input signal and pitch emphasis is provided before the coding process.

Figure 14:
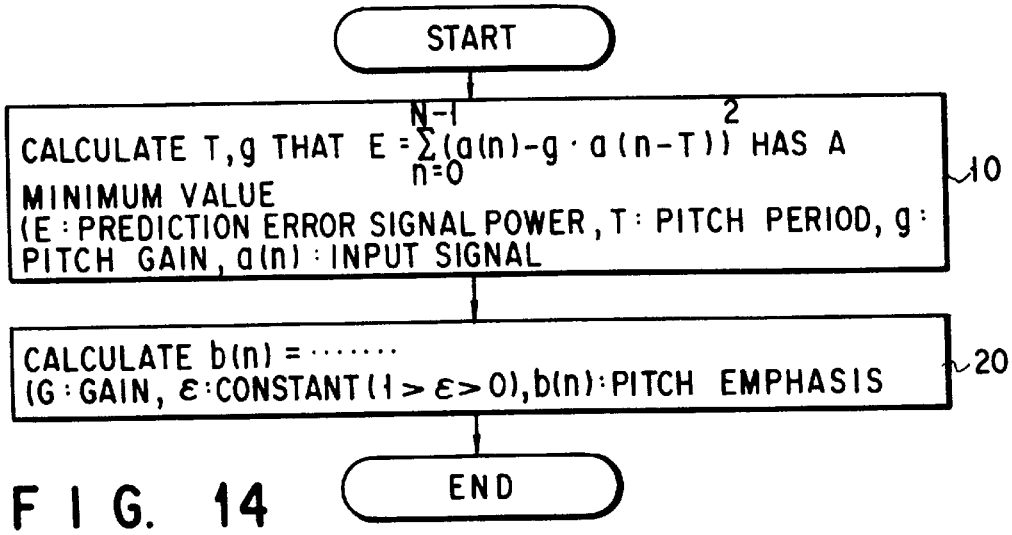
FIG. 14 is a flow-chart showing the processing in the pitch emphasis section.

The pitch emphasis section 100 comprises a pitch analysis computation unit 101 and a pitch emphasis computation unit 102. Note that the contents of the processing of the pitch analysis computation unit 101 will be explained with reference to FIG. 14. An input signal a(n) is sequentially inputted to a pitch analysis computation unit 101. The pitch analysis computation unit 101 performs pitch analysis at a certain analysis interval, and outputs a pitch period T and a pitch gain g. Taking into consideration the constancy of speech and the calculation amount, a suitable analysis interval is 5 ms to 10 ms. More specifically, the pitch analysis computation unit 101 analyzes the input signal a(n) at the analysis interval of 5 ms to 10 ms to obtain the pitch period T and the pitch gain g.

In the pitch analysis computation unit 101, an input signal a(n) is predicted by using a past signal a(n−t) preceding by a time T sample, and outputs T which minimizes the power of the prediction error signal. Specifically, the prediction error signal power E is expressed as follows.

$$E = \sum_{n=0}^{N-1} (a(n) - g \cdot a(n-T))^2 \quad (11)$$

$$(T = 20 \text{ to } 147)$$

Here, g denotes a pitch gain and N denotes a pitch analysis length. To obtain a stable pitch period, a pitch analysis length of, e.g., N=40 to 256 is preferable. The equation (11) is partially differentiated, and the prediction error signal power E becomes minimum when the value becomes 0. The equation is solved as follows.

$$E = \sum_{n=0}^{N-1} a^2(n) - \frac{\left(\sum_{n=0}^{N-1} a(n)a(n-T)\right)^2}{\sum_{n=0}^{N-1} a^2(n-T)} \tag{12}$$

The value of T which minimizes the equation (12) expresses the pitch period. The first term in the right side of the equation (12) is a constant, and therefore, a pitch period T which maximizes the second term in the right side of the equation is searched in actual procedures. In this stage, the pitch gain g is expressed as follows.

$$g = \frac{\left(\sum_{n=0}^{N-1} a(n)a(n-T)\right)}{\sum_{n=0}^{N-1} a^2(n-T)} \tag{13}$$

In addition, where a generalized stationary can be assumed from an input signal a(n), the second term in the right side of the equation (12) and the denominator in the right side of the equation (13) are expressed as follows.

$$\text{Denominator} = \sum_{n=0}^{N-1} a^2(n) \tag{14}$$

If only this value is obtained outside the search loop of the pitch period T, the calculation amount can be reduced. In this manner, a pitch period T and a pitch gain g can be obtained by the pitch analysis computation section 101 (in a step S10).

Although the above explanation of this embodiment has been made with reference to a method of obtaining a pitch period and a pitch gain with use of a primary pitch prediction filter, a higher order prediction filter may be used. In addition, another pitch analysis method, e.g., a zero-crossing method, an auto-correlation method, a cepstrum method or the like may be used.

The next explanation will be made to the pitch emphasis computation unit 102. The pitch emphasis computation unit 102 uses a pitch period T and a pitch gain g obtained by the pitch analysis computation unit 101 to emphasize an input signal a(n). Here, explanation will be made to a case of using an all-pole pitch filter. The transmit function of a pole type pitch filter can be expressed as follows.

$$B(z) = \frac{G}{1 - g \cdot \epsilon \cdot z^{-T}} A(z) \tag{15}$$

Here, A(z) denotes a z-transformation value of an input signal a(n), B(z) denotes a z-transformation value of an input signal b(n), G denotes a gain, and g denotes a pitch gain. Further, $\epsilon$ is a constant which is equal to or greater than 0 and is smaller than 1, and $\epsilon$=0.8 is recommended. To avoid making an oscillation filter, it is necessary to monitor that a product of g and $\epsilon$ is always maintained smaller than 1. For example, in case where the product of g and $\epsilon$ exceeds 0.8, it is necessary to additionally provide an exceptional treatment for forcibly limiting the product of g and $\epsilon$ to 0.8.

The equation (15) is expressed as follows within the time area.

$$b(n)=G\cdot a(n)+g\cdot\epsilon\cdot b(n-T) \tag{16}$$

According to the equation (16), it is possible to attain a signal b(n) obtained by subjecting an input signal to pitch emphasis (in a step S20).

The above explanation has been made a case of using a primary pitch emphasis filter. However, the number of stages of the pitch emphasis filter is not always one, but the pitch emphasis filter may have as many stages as the number of analysis stages of the pitch analysis computation unit 101. In addition, although the above explanation has been made for a case where a pole type pitch filter is used, it is naturally possible to use, for example, an all-zero pitch filter, pole-zero pitch filter, etc.

Although the characteristic is changed depending on the pitch gain g in the pitch emphasis computation expressed by the equation (16), it is possible to use a method of performing pitch emphasis using a pitch emphasis computation defined by a predetermined constant (e.g., 0.7) in place of using a product of the pitch gain g and a constant $\epsilon$. In this case, calculation of the pitch gain g is not necessary, and therefore, it is sufficient if only a pitch period T which maximizes the numerator term of the equation (13), resulting in an advantage in that the calculation amount can be reduced.

Figure 12:
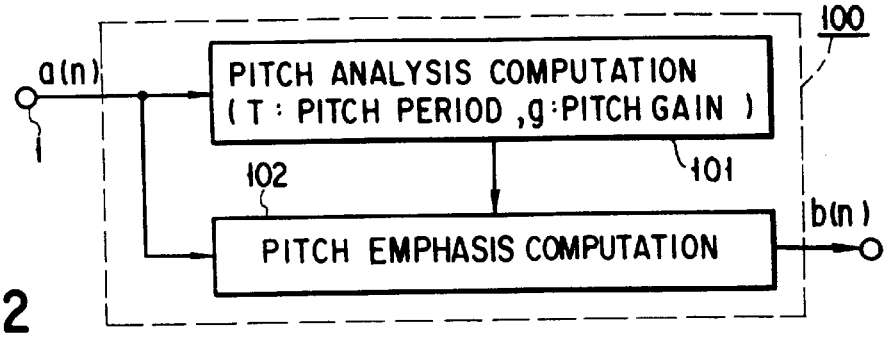
FIG. 12 is a block diagram of the pitch emphasis section shown in FIG. 11.
Figure 13:
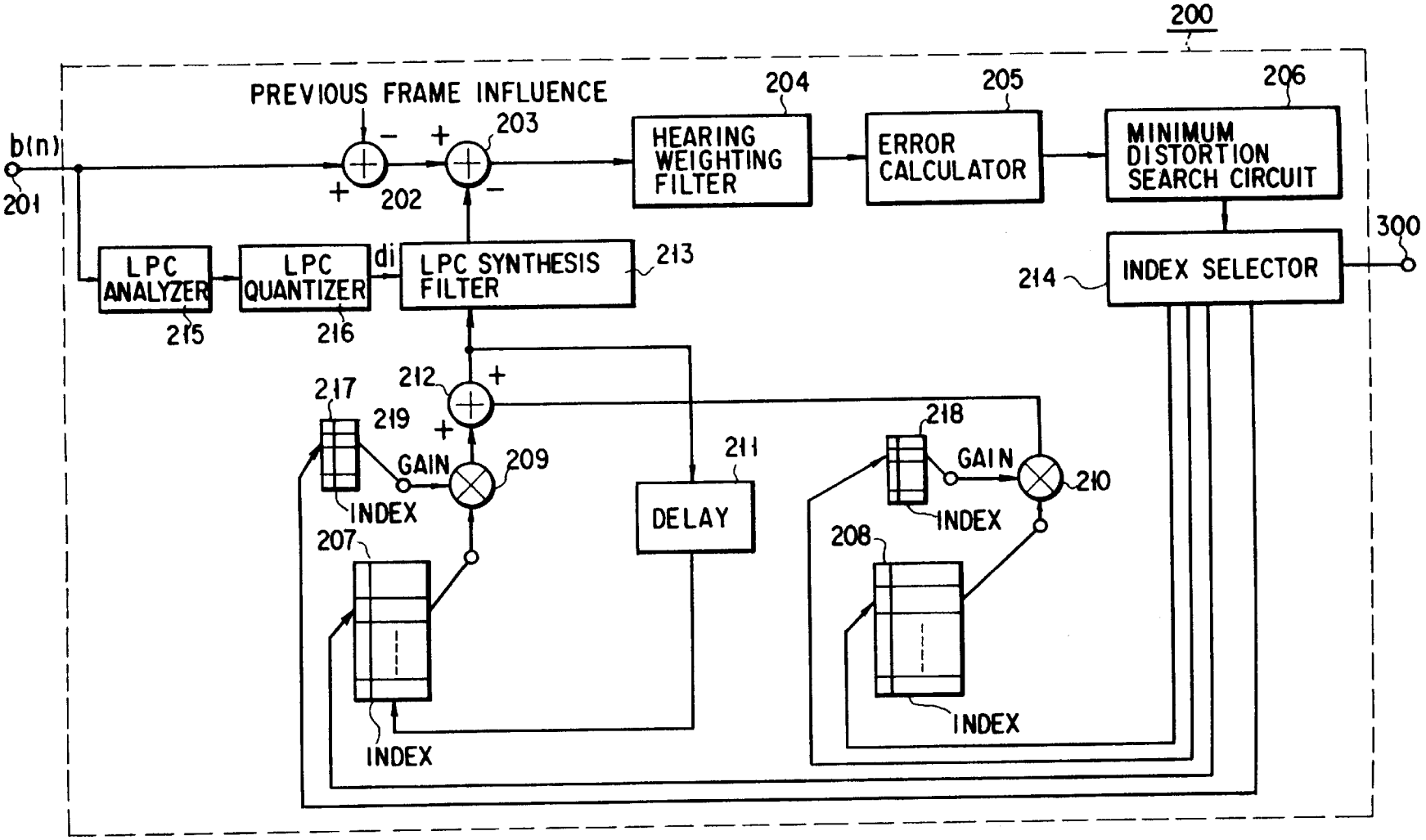
FIG. 13 is a block diagram of a coding section shown in FIG. 11.

FIG. 13 shows another example of a pitch emphasis section 100. The pitch emphasis section 100 has a structure obtained by adding a gain adjust computation unit 103 to the pitch emphasis section shown in FIG. 12. The gain adjust computation unit 103 receives an input signal a(n) and a pitch signal b(n) from the pitch emphasis computation unit 102.

Figure 37:
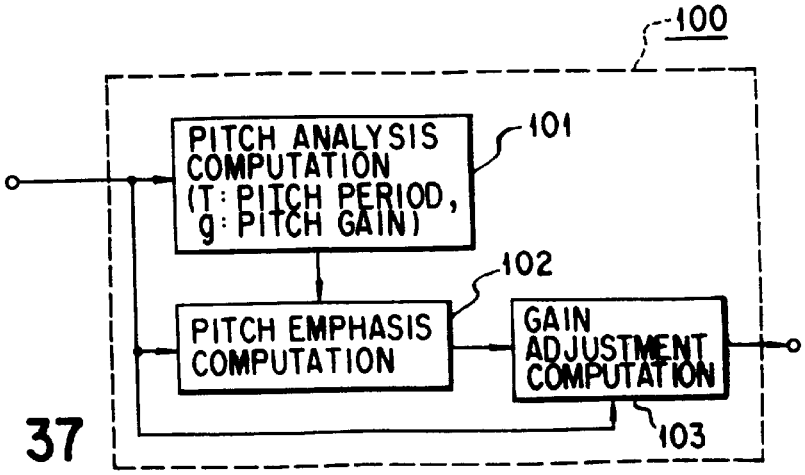
FIG. 37 is a block diagram of a pitch emphasis section used in a coding apparatus of the present invention.
Figure 38:
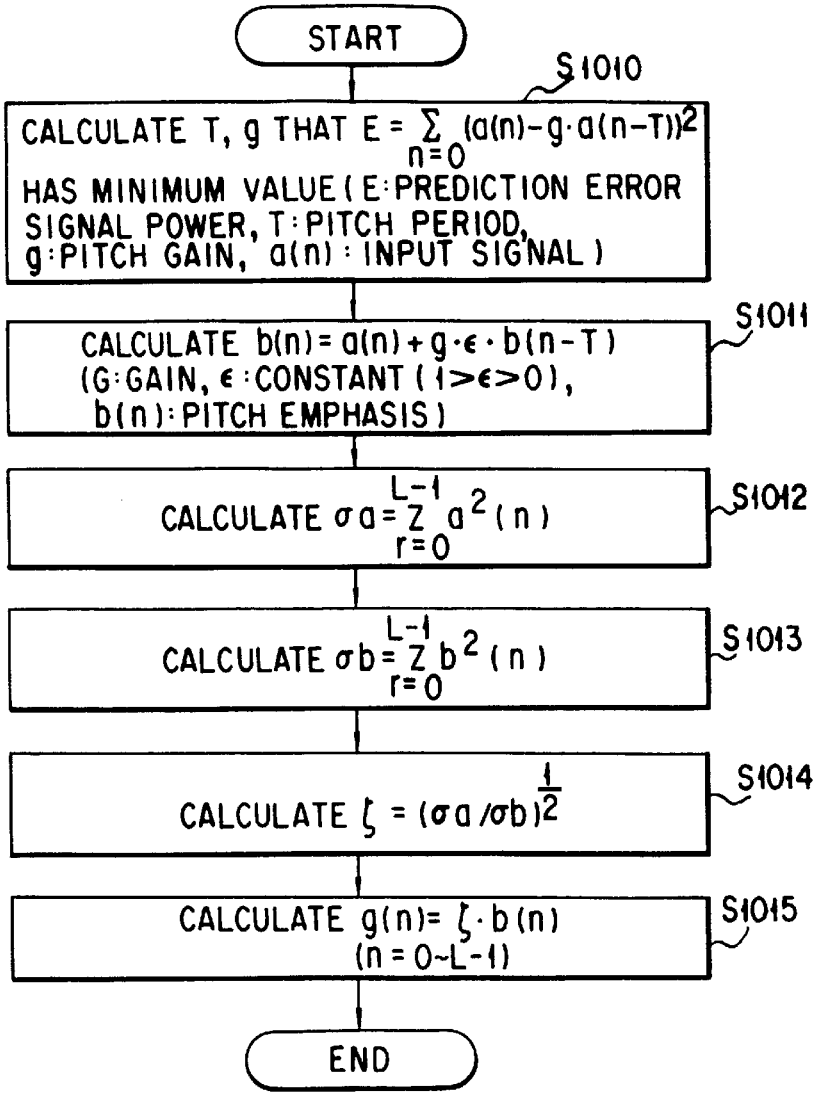
FIG. 38 is a flow-chart for explaining operation of the pitch emphasis section of FIG. 37.

The gain G of the equation (16) is given so that the power of the signal b(n) after performing the pitch emphasis computation is equal to the power of then input signal a(n). In the structure shown in FIG. 37, a gain adjustment computation section 103 performs a gain adjustment so that the power of an input signal a(n) corresponds to the power of a signal b(n) after performing the pitch emphasis computation, supposing G=1. The gain adjustment computation section 103 performs a gain adjustment by multiplying a signal b(n) after pitch emphasis computation, by a coefficient obtained by the power oa of an input signal a(n) and the power σb of a signal b(n) after pitch emphasis computation. The specific contents of this processing will be explained with reference to FIG. 38. Note that those components of FIGS. 37 and 38 which are referred to by the same reference names as those of FIGS. 12 and 14 have the same functions of corresponding components of FIGS. 12 and 14. Therefore, explanation of those components will be omitted.

The power ca of an input signal a(n) buffered by a frame length L is obtained in accordance with the following equation (in a step S1012). A preferable frame length L is about 40 to 160.

$$\sigma a = \sum_{i=0}^{L-1} a^2(n) \tag{17}$$

The power σb of a signal b(n) after pitch emphasis computation corresponding to each sample of the input signal a(n) is obtained in a manner similar to the equation (17) (in a step S1013). Although the pitch emphasis computation is performed in accordance with the equation (17), an attention should be paid to that the gain G=1 is supplied (in a step S1013).

$$\sigma b = \sum_{i=0}^{L-1} b^2(n) \tag{18}$$

A coefficient ζ is obtained from σa and σb in accordance with the equation (19) as follows (in a step S1014).

$$\zeta=(\sigma a/\sigma b) \tag{19}$$

Where g(n) is a signal obtained by multiplying a signal b(n) after pitch emphasis computation by ζ for each sample, the g(n) which can be expressed as follows is outputted (in a step S1015).

$$g(n)=\zeta\cdot b(n)(n=0 \text{ to } L-1) \tag{20}$$

The method of a gain adjustment performed by a gain adjustment computation 103, of course, is not limited to the method as described above, and is based on that a gain adjustment is achieved by multiplying the pitch a signal b(n) after pitch emphasis computation by a coefficient obtained from σa and σb such that the power of an input signal is equal to the power of an output signal.

Figure 39:
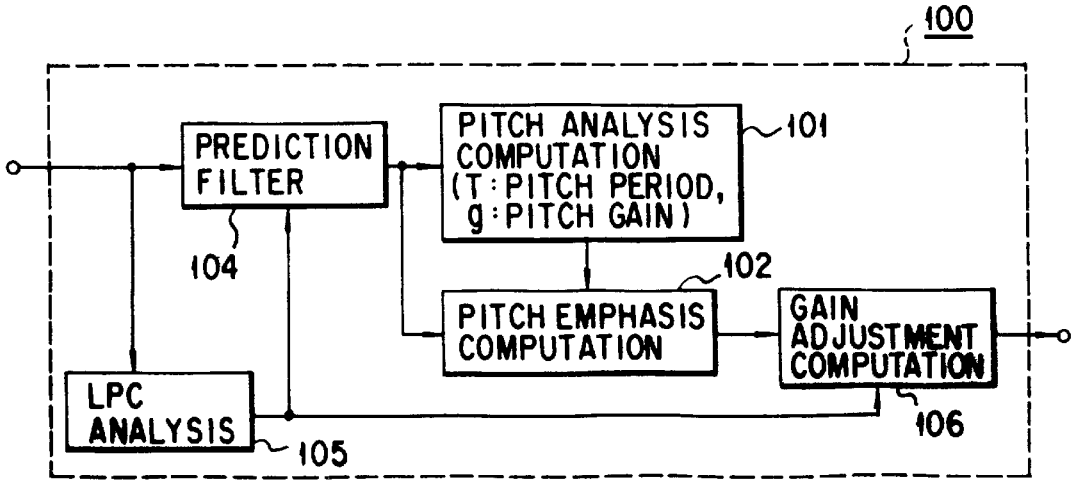
FIG. 39 is a block diagram of a pitch emphasis section according to another modification.
Figure 40:
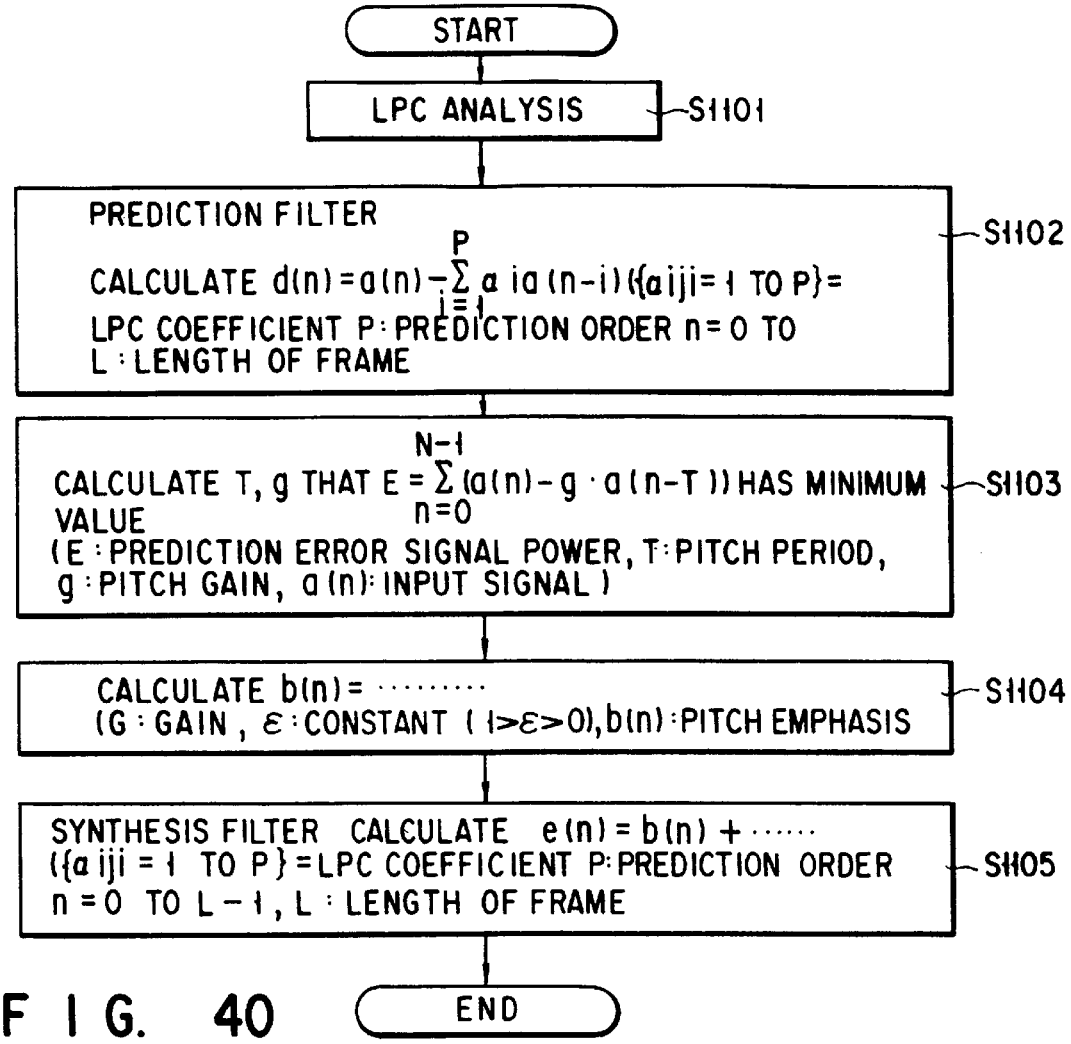
FIG. 40 is a flow-chart for operation of the pitch emphasis section shown in FIG. 39.

FIG. 39 shows another structure of a pitch emphasis section 100. The pitch emphasis section 100 shown in FIG. 39 has a structure obtained by adding a prediction filter 104 supplied with an input signal, a LPC analyzer 105 and a synthesis filter 106 to the emphasis section shown in FIG. 12. The contents of the processing will be explained with reference to FIG. 40. Note that those components of FIGS. 39 and 40 which are referred to by the same reference names as those of FIGS. 12 and 14 have the same functions of corresponding components of FIGS. 12 and 14, and therefore, explanation of those components will be omitted.

At first, LPC analysis if performed with use of an input signal a(n), to obtain an LPC coefficient {al:i=1 to P} (in a step S1101). P denotes the number of letters to be analyzed, and is set to P=10 in this case. As a method of LPC analysis, there is an auto-correlation method, a covariance method, an FLAT algorithm, or the like, and any of these methods can be used. In the next, a prediction filter is formed from an LPC coefficient, and an input signal is made pass through the prediction filter, thereby to generate a prediction remaining difference signal d(n) (in a step S1102). The prediction remaining difference signal d(n) is expressed as in the following equation (21) with use of an LPC coefficient. Here, L denotes a frame length and L is preferably 40 to 160.

$$d(n) = a(n) - \sum_{i=1}^{P} \alpha ia(n = i) \tag{21}$$

where n=0 to L−1

In the next, a pitch period T and a pitch gain g which minimize E are obtained in accordance with the equation (11) (in a step S1103). Note that computation is performed, with a(n) of the equation (11) replaced with d(n). Next, a pitch emphasis signal b(n) is obtained in accordance with the equation (16) (in a step S1104). Note that the computation is performed with a(n) of the equation (16) replaced with d(n).

At last, a synthesis filter is formed from an LPC coefficient, and the pitch emphasis signal b(n) is passed through the synthesis filter to generate a pitch-emphasized input signal e(n) (in a step S1105).

$$e(n) = b(n) + \sum_{i=1}^{P} \alpha ia(n = i) \tag{22}$$

where n=0 to L−1

The pitch-emphasized input signal e(n) thus obtained is encoded by an encoder 200.

Figure 41:
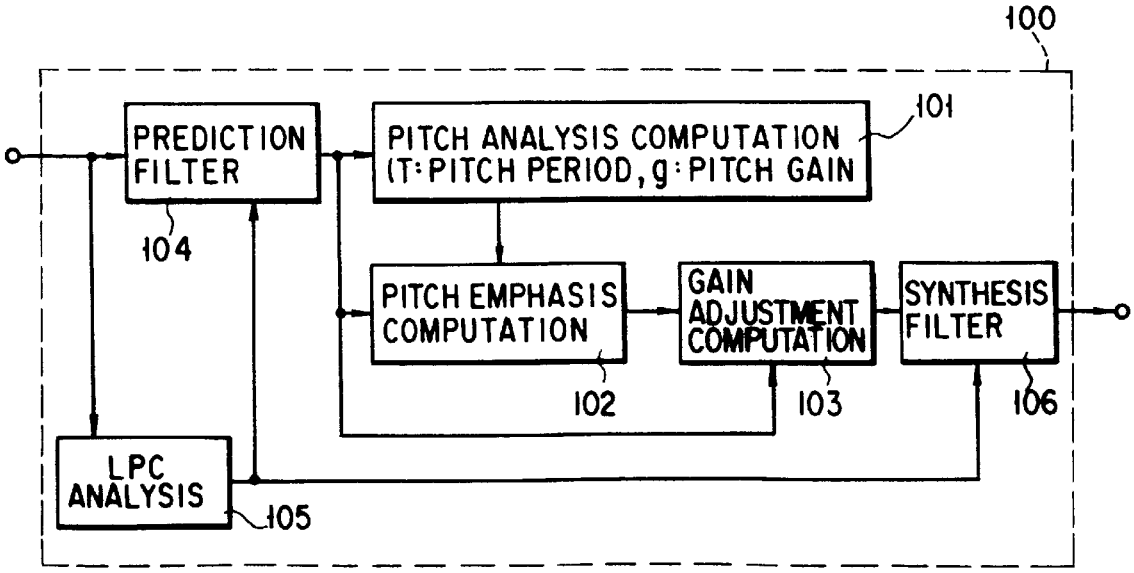
FIG. 41 is a block diagram of a pitch emphasis section according to another modification.
Figure 42:
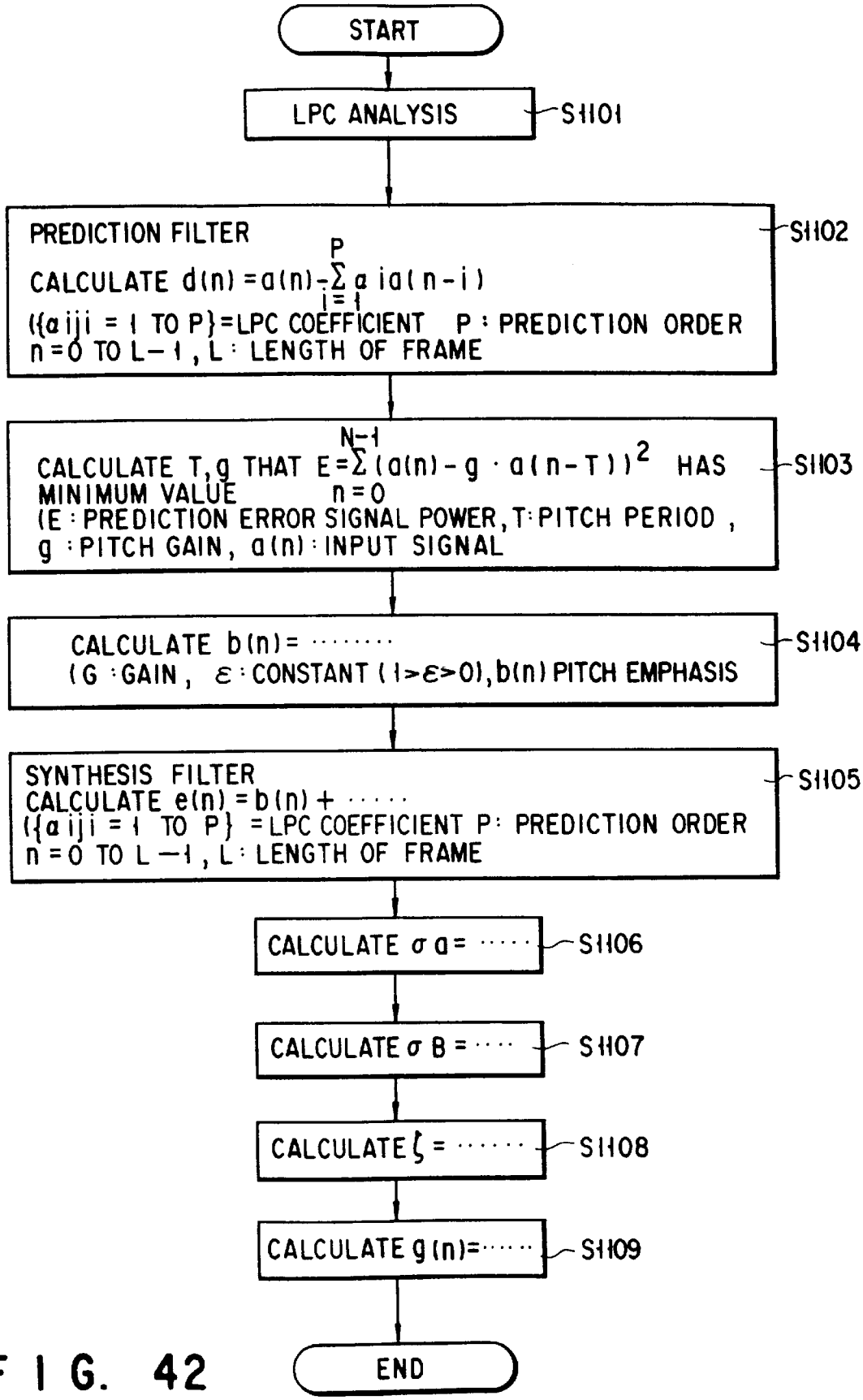
FIG. 42 is a flow-chart for operation of the pitch emphasis section shown in FIG. 41.

FIG. 41 shows another structure of the pitch emphasis section 100. The contents of the processing is shown in FIG. 42. This structure is characterized by including gain adjustment computation. However, those components of FIGS. 41 and 42 which are referred to by the same reference numerals as those of FIGS. 39 and 40 have the same functions as corresponding components of FIGS. 39 and 40, and therefore, explanation of those components will be omitted. In addition, since gain adjustment computation has already been explained with reference to FIG. 37, explanation thereof will be omitted herefrom.

Although explanation has been made to a method of analyzing a prediction remaining difference signal d(n) when a pitch period and a pitch gain are obtained in a step S11, it is possible to analyze and obtain an input signal a(n). However, it has been well-known that a prediction remaining difference signal ensures more accurate pitch analysis since a short-time correlation is removed from a prediction remaining difference signal, and therefore, a method of analyzing a prediction remaining difference signal d(n) is recommended.

Thus, a pitch emphasis signal b(n), a pitch emphasis signal g(n) after a gain adjustment, an input signal e(n) subjected to pitch emphasis, and a pitch-emphasized input signal f(n) after a gain adjustment are respectively outputted in the structures of FIG. 12, FIG. 37, FIG. 39, and FIG. 41. These output signal are supplied to a coding section 200, and coding processing is performed. Further, index information obtained as a result of coding by the coding section 200 is outputted from an output terminal 300.

The coding section 200 may adopt a structure of a CELP method as illustrated in the block diagram shown in FIG. 13. In this figure, an input signal a(n) subjected to pitch emphasis by the pitch emphasis section 100 is inputted through an input terminal 201 in units of frames. One frame consists of L signal samples. In general, L=160 is adopted where the sampling frequency is 8 kHz. Note that, prior to a drive signal vector, LPC analysis is performed on a signal subjected to pitch emphasis, by an LPC analysis section 215, an LPC coefficient thereby obtained is quantized by an LPC quantizer 216, and the quantized LPC coefficient σi (σi: i=1, 2, . . . , P) and an index (number) are extracted. The LPC coefficient ai is supplied to an LPC synthesis filter 213. Note that P is a prediction number of stages and P=10 is generally used. A transmit function for an LPC synthesis filter 213 is supplied by the following equation (23).

$$H(z) = \frac{1}{1 - \sum_{i=1}^{P} \alpha_i Z^{-i}} \tag{23}$$

Now, explanation will be made to steps for searching for an optimum excitation signal vector while synthesizing a speech signal. At first, an influence onto a current frame from an internal state of the synthesis filter 213 in a previous frame is subtracted from one frame of speech signals inputted into an input terminal 201, by a subtracter 202. A signal train obtained from the subtracter 202 is divided into four sub-frames, and respectively form target signal vectors for the sub-frames.

A drive signal vector as an input signal of an LPC synthesis filter 213 is obtained by adding a value, which is obtained by multiplying an adaptive vector selected from an adaptive codebook 207 by a predetermined gain obtained from a gain codebook 217 by a multiplier 209, with a value which is obtained by multiplying a noise vector selected from white noise codebook 208 by a predetermined gain obtained from a gain codebook 218 by a multiplier 210, by means of an adder 212.

Here, the adaptive codebook 207 performs pitch prediction analysis described in the prior art reference 1, through closed loop operation or analysis by synthesis, and the details of thereof are described in W. B. Kleijin, D. J. Kransinski, and R. H. Ketchum. "Improved Speech Quality and Efficient Vector Quantization in CELP", Proc. ICASSP, 1988, pp. 155 to 158 (prior art reference 2). According to the reference 2, a drive signal for the LPC synthesis filter 213 is delayed by one sample by a delay circuit 211 for a pitch search range of a to b (where a and b denote sample numbers of drive vectors, i.e., a=20 and b=147), and an adaptive vector for the pitch period of an a–b sample is prepared and is stored into an adaptive codebook 207.

To perform search of an optimum adaptive vector, code words of adaptive vectors corresponding to respective pitch periods are read out from the adaptive codebook 207, one after another, and are respectively multiplied by predetermined gains obtained from the multiplier 209. Filter processing is performed by an LPC synthesis filter 213, and a synthesis signal vector is generated. The synthesis signal vector thus generated is subjected to subtraction with respect to a target vector, by a subtracter 203. An output of the subtracter 203 is inputted through a hearing weighting filter 204 to an error calculator 205, and an average quadratic error is obtained. Information concerning the average square error is further inputted into a minimum distortion searching circuit 206, and the minimum value is detected.

The above steps are performed on all the candidates of adaptive vectors in the adaptive codebook 207, and an index of a candidate which supplies a minimum value of the average square error in the minimum distortion searching circuit 206. The index of a gain to be multiplied by the multiplier 209 is determined so as to minimize the average square error.

The adaptive vector obtained from the above steps is multiplied by a gain, and a synthesis speech signal vector is generated through filter calculation by the LPC synthesis filter 213. The vector thus generated is subtracted from a target vector, thereby resulting in a signal which is used as a target vector when searching a remaining speech vector.

Next, an optimum noise vector is searched in a similar manner. Specifically, code words of noise vectors are read out from the noise codebook 208, one after another, and are subjected to multiplication by a gain obtained from the gain codebook 218 by the multiplier 210, to filter calculation by the LPC synthesis filter 213. Thereafter, generation of a synthesis speech signal vector and calculation of an average square error with respect to a target vector are performed on each of all noise vectors. An index of a noise vector and an index of a gain which supply a minimum value of the average square error are obtained. In this manner, indexes of the adaptive codebook 207 and 208, an index of an LPC coefficient $\alpha l$ (i: i=1, 2, . . . , P) obtained by the LPC quantizer, and an indexes of gains inputted into the multiplier 209 and 210 are each transmitted from an index selector 214. Note that the hearing weighting filter 204 is used to shape a spectrum of an error signal outputted from a subtracter 203, thereby to reduce distortion sensed with human ears.

As has been described above, the pitch of an input signal is emphasized, so that the signal much more easily match with a drive signal model representing pitch information in form of an adaptive codebook. Therefore, it is possible to explain that the coding efficiency of an adaptive codebook is improved, and subjective quality of synthesis speech is improved.

Note that the coding scheme is not limited to a CELP method, but other coding schemes are naturally applicable.

Figure 20:
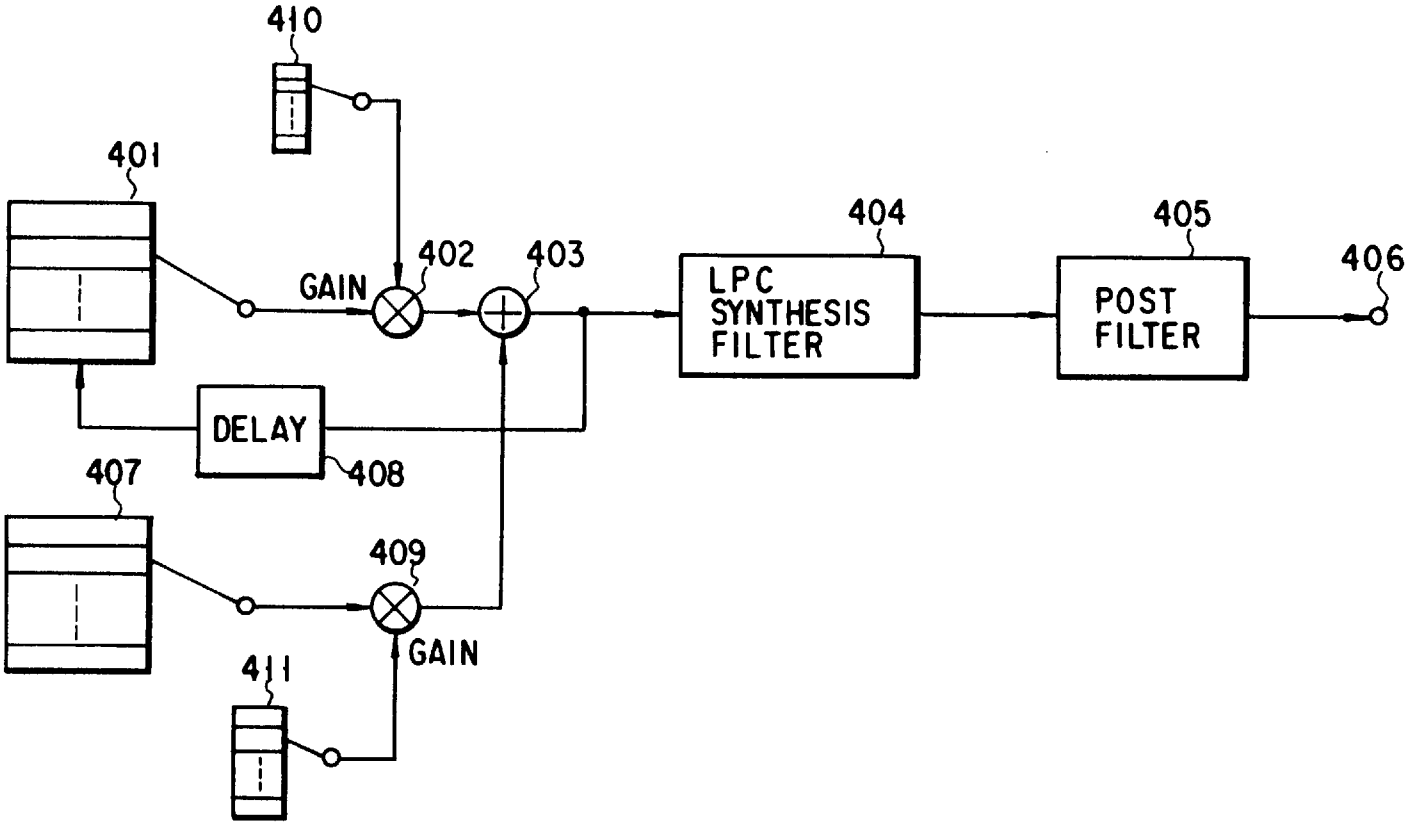
FIG. 20 is a block diagram of a speech decoding section regarding to the coding apparatus of the present invention.

FIG. 20 is a block diagram showing a speech encoder using a CELP method. An adaptive vector is extracted from an adaptive codebook 401 with use of an index of an adaptive vector transmitted from an encoder, and a gain is decoded from a gain codebook 410 on the basis of an index transmitted from the coding section. The adaptive vector and the gain are subjected to multiplication by a multiplier 402. In a similar manner, a noise vector is extracted from a noise codebook 407, and is multiplied by a gain decoded from a gain codebook 411, by a multiplier 409.

In the next, these vectors are added with each other by an adder 403 to generate a drive vector which is passed through an LPC synthesis filter 404 whose setting is performed by an LPC coefficient transmitted from a coding section, thereby to generate a synthesis signal. Further, to improve subjective quality of the synthesis signal, the synthesis signal is passed through a post filter 405 to obtain a synthesis speech which is outputted through an output terminal 406. Finally, each drive signal is delayed by one sample and is stored into the adaptive codebook 401, to be ready for next processing.

Figure 27:
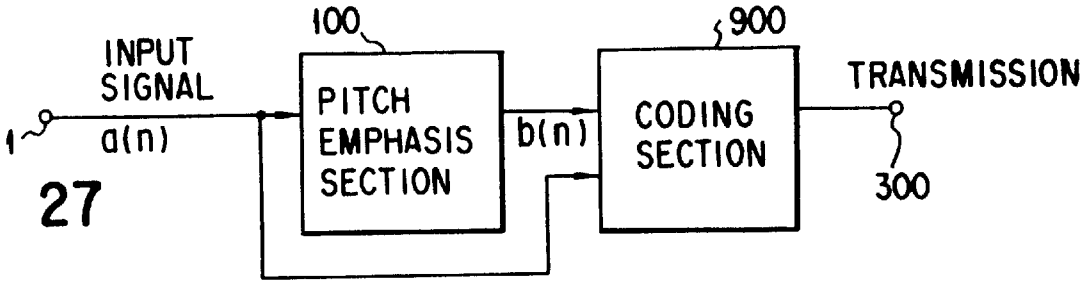
FIG. 27 is a block diagram showing a modification example of the seventh embodiment of the present invention.

In the seventh embodiment, although LPC analysis is performed in the encoder 900 with use of a pitch-emphasized signal b(n), the LPC analysis may be performed with use of an input signal a(n). In this case, as shown in FIG. 27, an input signal a(n) is inputted together with a pitch-emphasized signal b(n), into the coding section 200.

Figure 16:
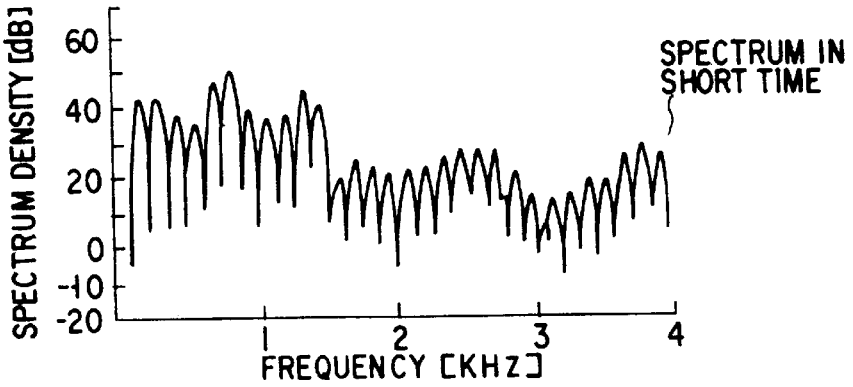
FIG. 16 is a graph showing short-time spectrums of an input signal.
Figure 17:
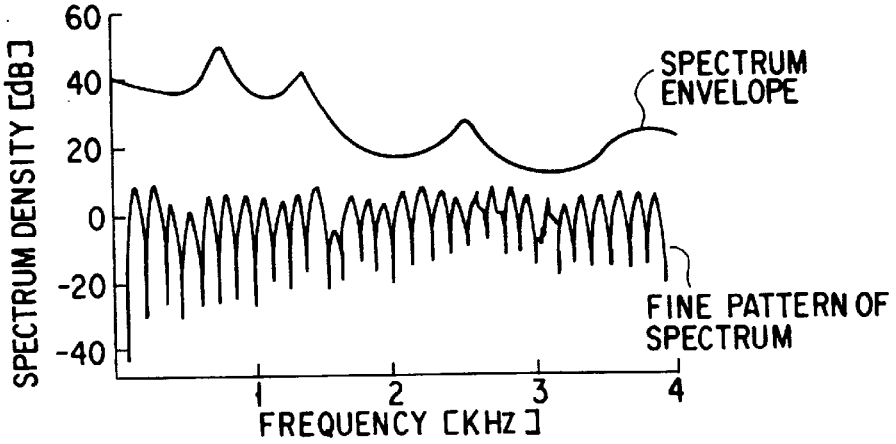
FIG. 17 is a graph showing a relationship between a spectrum envelop and a fine spectrum structure.
Figure 18:
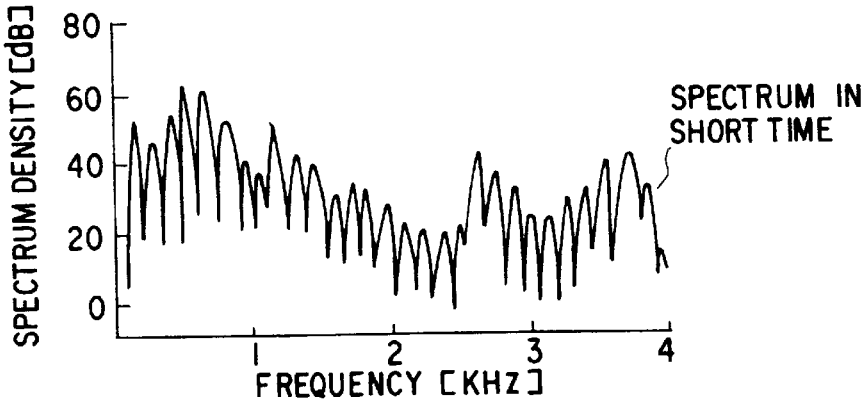
FIG. 18 is a graph showing a short-time spectrum when an input signal is subjected to pitch emphasis.
Figure 19:
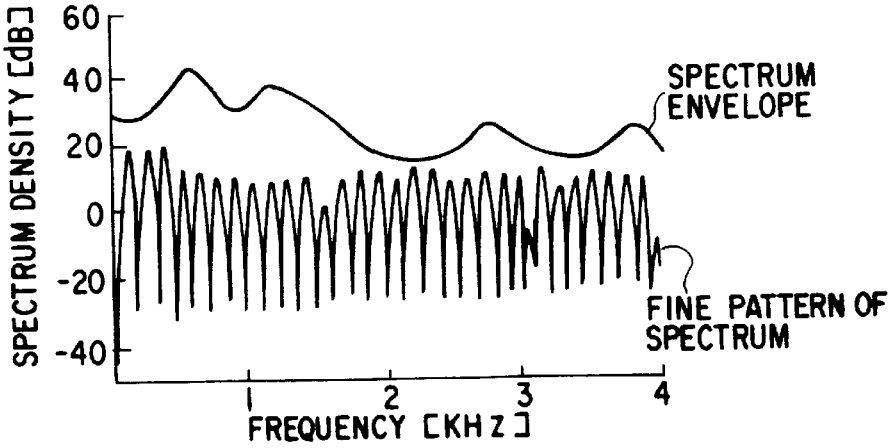
FIG. 19 is a graph showing a relationship between a spectrum envelope and a fine spectrum structure.
Figure 28:
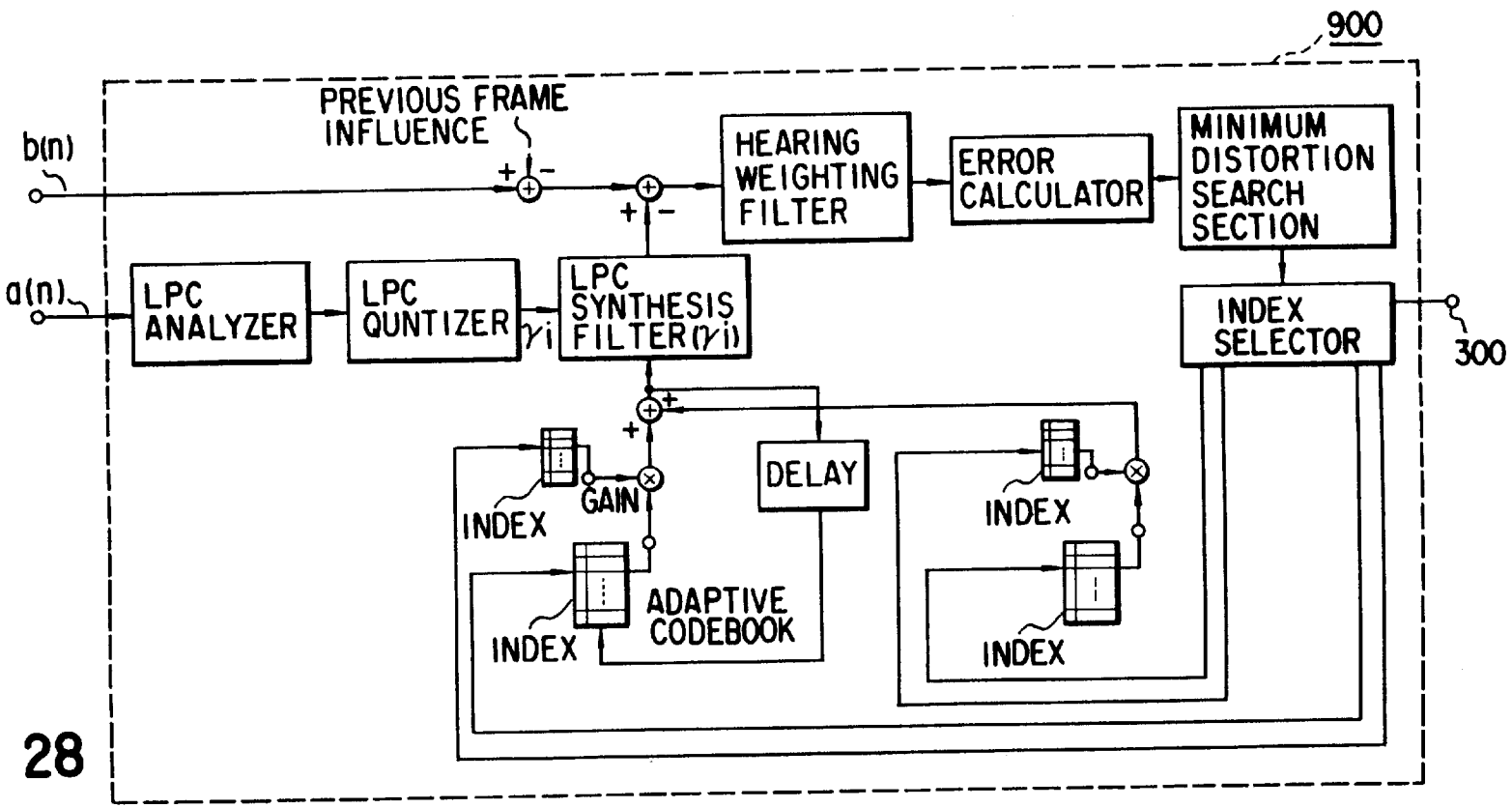
FIG. 28 is a block diagram showing the structure of a coding section.

Further, this embodiment is different from FIG. 13 in that LPC analysis is performed with use of an input signal a(n), as shown in FIG. 28. An advantage of this embodiment will be explained below with reference to FIGS. 16, 17, 18, and 19. FIG. 16 shows a spectrum of an input signal and FIG. 17 shows a spectrum envelope of an input signal as a fine spectrum structure. FIG. 18 shows a spectrum when an input signal is subjected to pitch emphasis. FIG. 19 shows a spectrum envelope and a fine spectrum structure when an input signal is subjected to pitch emphasis.

In general, a short-time spectrum of speech can be regarded as a product of a spectrum envelope expressing phonemic information and a fine spectrum structure expressing pitch information. An LPC coefficient expresses a spectrum envelope. If LPC analysis is performed with respect to a pitch-emphasized signal b(n), a fine spectrum structure is emphasized as shown in FIG. 19, and therefore, a short-time spectrum (FIG. 18) is greatly influenced by the fine spectrum structure, in some cases. Therefore, there may be cases in which it is difficult to extract an accurate LPC coefficient from a signal subjected to pitch emphasis as shown in FIG. 19, resulting in deterioration in subjective quality.

Figure 15:
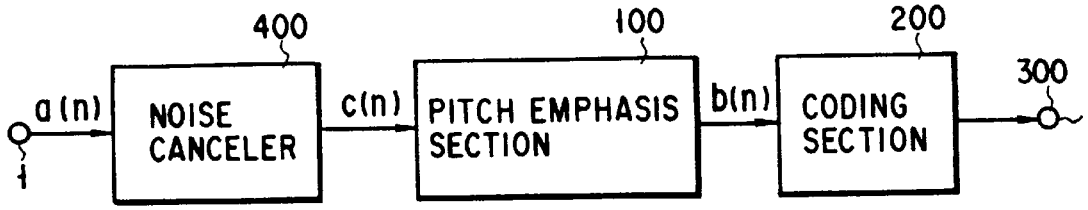
FIG. 15 is a block diagram of a coding apparatus obtained by adding a noise canceler to the apparatus of FIG. 11.

On the contrary, according to this embodiment, an input signal a(n) before pitch emphasis is used to perform LPC analysis, and therefore, a short-time spectrum of an input signal shown in FIG. 16 is not easily influenced by the fine spectrum structure of FIG. 7, so that it is possible to extract an LPC coefficient which expresses a substantially accurate spectrum, as shown in FIG. 15.

When the pitch emphasis section has a structure shown in FIG. 39 or FIG. 41, the pitch emphasis section performs LPC analysis with use of a signal a(n) before being subjected to pitch emphasis, to obtain an LPC coefficient. Therefore, if a coding section 900 is supplied with the LPC coefficient obtained by the pitch emphasis section together with an input signal subjected to pitch emphasis while preventing the encoder from newly performing LPC analysis, an accurate LPC coefficient can be used in the coding section, as has been explained above, and LPC analysis need not be performed by the coding section.

Figure 43:
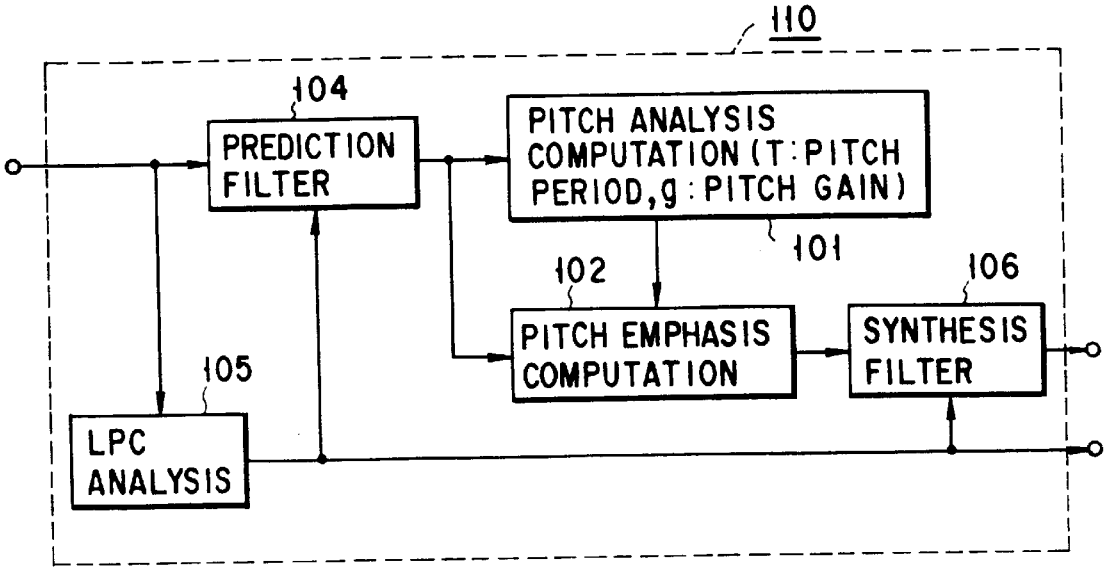
FIG. 43 is a block diagram of a pitch emphasis section according to another modification.
Figure 44:
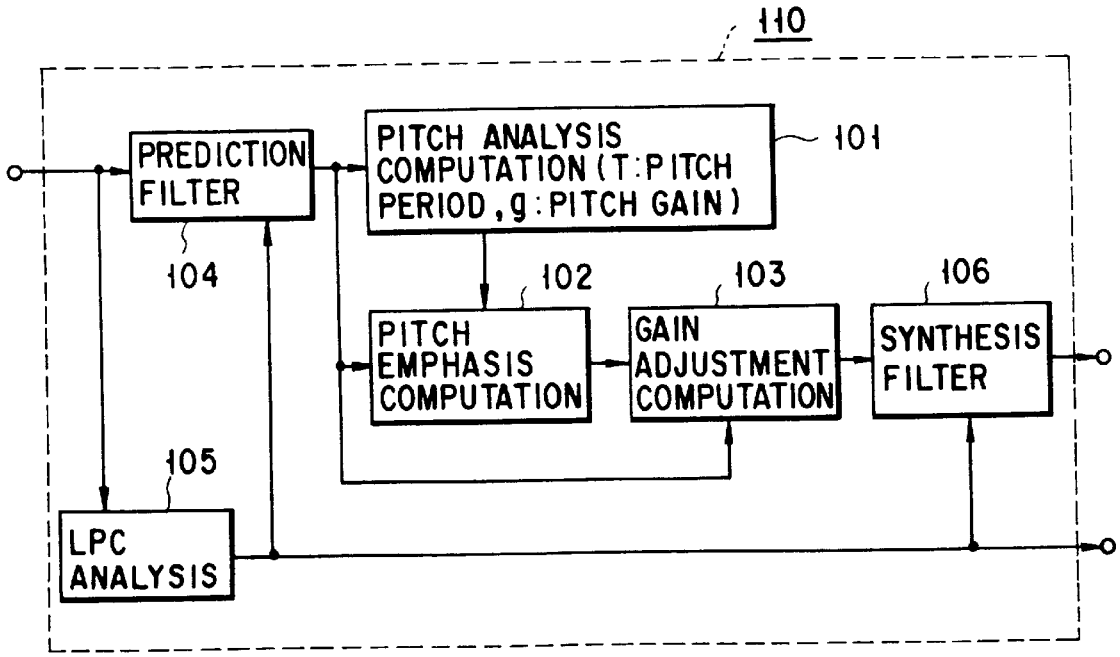
FIG. 44 is a block diagram of a pitch emphasis section according to another modification.
Figure 45:
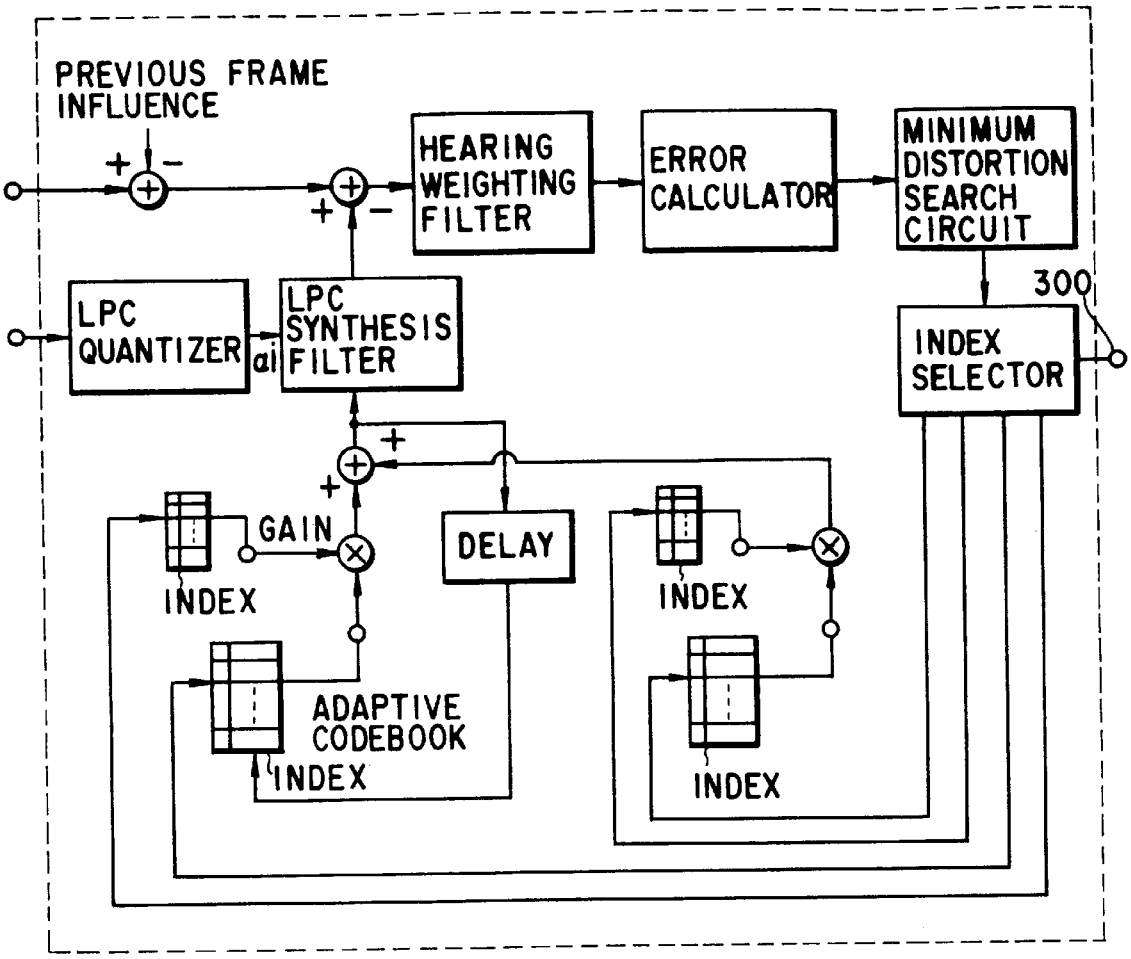
FIG. 45 is a block diagram of a coding section of the coding apparatus of the present invention.
Figure 46:
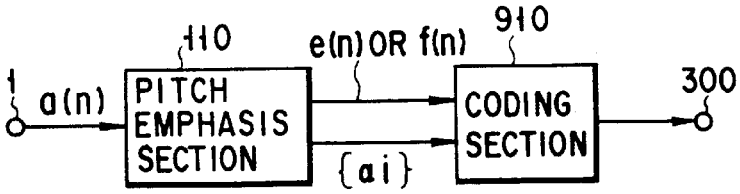
FIG. 46 is a block diagram of a coding apparatus with a pitch emphasis section, according to an eleventh embodiment.

FIG. 43 shows a pitch emphasis section 110 which has the structure of FIG. 39 and which outputs an LPC coefficient together with a pitch emphasis signal. Likewise, FIG. 44 shows a pitch emphasis section 110 which has the structure of FIG. 41 and which outputs an LPC coefficient together with a pitch emphasis signal. In addition, the structure of an encoder using the pitch emphasis section 110 is shown as a coding section 910 in FIG. 45. FIG. 45 is different from FIG. 28 in that LPC analysis is not performed. FIG. 46 shows a structure in which the pitch emphasis section 110 is connected to the coding section 910. As for a signal outputted from the pitch emphasis section 110, an input signal e(n) subjected to pitch emphasis is outputted when the structure of FIG. 43 is used, while an input signal f(n) subjected to pitch emphasis after a gain adjustment is outputted when the structure of FIG. 44 is used. In addition, an LPC coefficient obtained by LPC analysis is always outputted.

FIG. 15 shows a speech coding apparatus according to an eighth embodiment of the present invention. However, those components which are referred to by the same reference names as those of the seventh embodiment have the same functions as those of FIG. 1.

Figure 29:
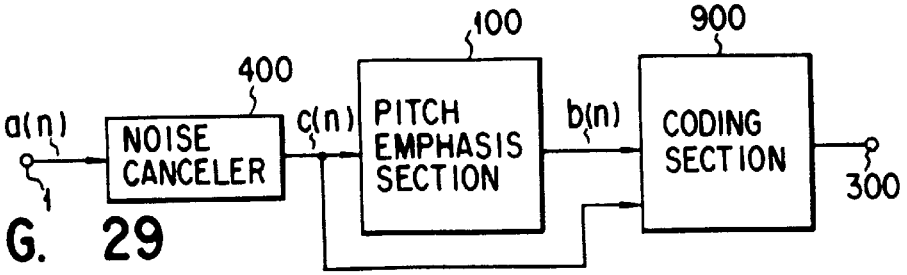
FIG. 29 is a block diagram showing a modification example of the seventh embodiment of the present invention.

The difference between this embodiment and the seventh embodiment is that pitch analysis and pitch emphasis are performed with use of a signal c(n) obtained as a result of making an input signal a(n) pass through a noise canceler 400. In this embodiment, an input signal a(n) is passed through a noise canceler to attenuate background noise, so that the pitch period and pitch gain can be obtained by a pitch analyzer with a higher accuracy. In addition, as described above, it is possible to extract an LPC coefficient which expresses a substantially accurate spectrum shape, and therefore, LPC analysis can be performed with use of a signal c(n) obtained through the noise canceler 400, as shown in FIG. 29.

Then, a speech coding apparatus according to the ninth embodiment of the present invention will be explained with reference to FIG. 21. Note that those components of FIG. 21 which are referred to by the same reference numbers as those of FIG. 1 have the same functions as those of FIG. 11, and explanation of those components will be omitted herefrom.

This embodiment is different from the seventh embodiment in that a determining section 500 determines whether an input signal whose pitch has been emphasized is coded or an input signal is directly coded, on the basis of an input signal a(n). On the basis of a result of determination made by the determining section 500, the determining section 500 supplies a switch 510 with an instruction. When all the input signals are subjected to pitch emphases as described in the above embodiment, the pitch gain g hardly become 0 even if an input signal which does not substantially include pitch information, and therefore, input signals are emphasized at any pitch period T. As a result of this, excessive emphasis is performed on an input signal, and therefore, subjective quality may be deteriorated. In addition, when an input signal mixed with background noise is supplied, the signal may be emphasized at a pitch period T' different from the pitch period T of speech under influences of the background noise. This results in deterioration in subjective quality. This problem becomes more serious when the mixed background noise has an intensive periodicity. Taking into consideration this problem, pitches of all the input signals are not emphasized in the following embodiment, but the following embodiment is arranged such that a certain determination condition is prepared and that pitch emphasis is performed only when the condition is satisfied. Therefore, the above problem can be avoided. As a determination reference of this embodiment, there is a method in which pitch emphasis is not performed when an input signal does not include much pitch information, e.g., with respect to a non-sound portion or a non-voice portion, while pitch emphasis is performed when an input signal includes much pitch information, e.g., with respect to voice portion. As another determination reference, there is a method in which pitch emphasis is not performed when the power of background noise is large, while pitch emphasis is performed when the background noise power is small. Further, there is another method in which pitch emphasis is not performed when periodic background noise is mixed in an input signal, while pitch emphasis is performed when non-periodic background noise is mixed in an input signal. In the following, three kinds of operations of the determining section 500 in FIG. 21 will be explained with reference to FIGS. 23 to 25.

Figure 23:
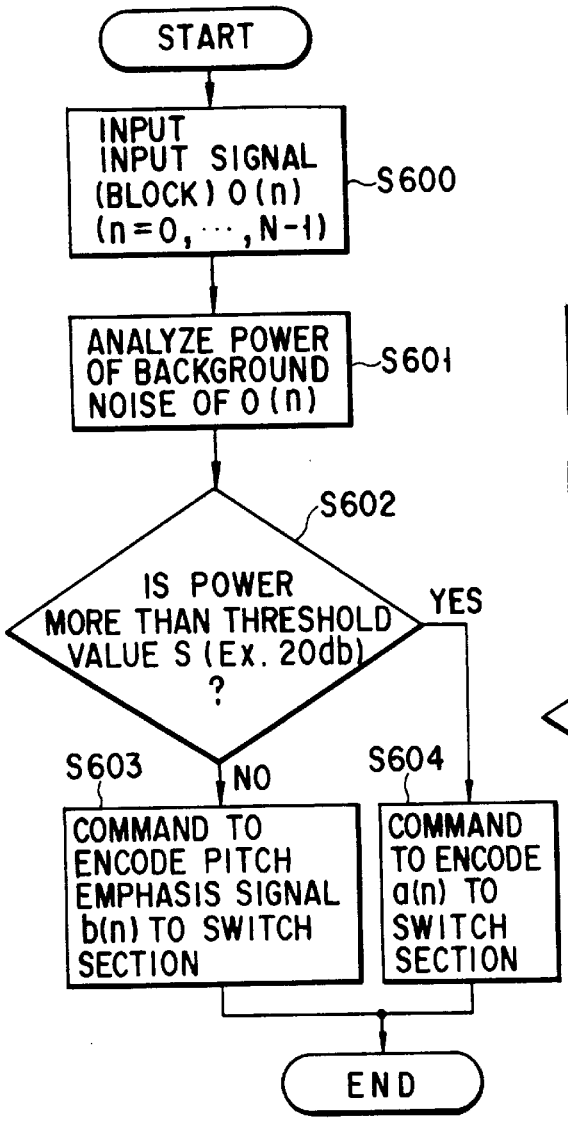
FIG. 23 is a flow-chart showing the processing in the determine section of the ninth embodiment of the present invention.

At first, an operation of the determining section 500 will be explained with reference to FIG. 23. As a determination reference of this embodiment, pitch emphasis is not performed when the power of background noise is large, while pitch emphasis is performed when the background noise power is small.

An input signal (block) a(n) is inputted, and the power of the background noise of the input signal is analyzed (in a step S601). Further, in a step S602, determination as to whether a pitch emphasis signal b(n) obtained by emphasizing the pitch of the input signal is coded (in a step S603) or the input signal a(n) is directly coded is made, depending on the threshold value S of the power of the background noise. Specifically, when the power of the background noise is greater than the threshold value S (e.g., 20 dB is preferable), a switch 510 is instructed so as to directly code an input signal a(n). When the power of the background noise is smaller than the threshold value S, the switch 510 is instructed so as to code a pitch emphasis signal obtained by emphasizing the pitch of an input signal. Whether a pitch emphasis signal is coded or an input signal a(n) is directly coded is thus determined depending on the threshold value, because signal components forming the background noise is undesirably subjected to pitch emphasis if the threshold value S for the background noise power is too high, and as a result, a coded signal whose those noise components are emphasized and which is difficult to hear clearly is decoded by the decoding side.

Figure 24:
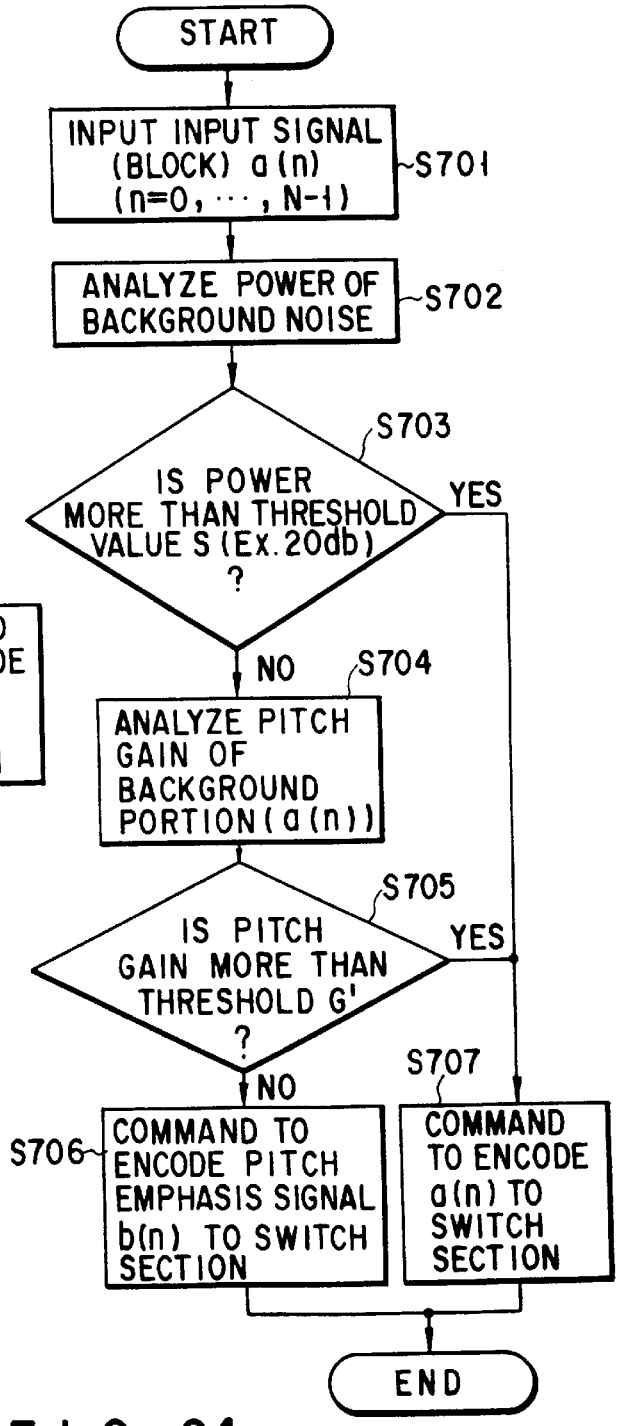
FIG. 24 is a flow-chart showing the processing in the determine section of the ninth embodiment of the present invention.

Another operation of the determining section 500 will be explained with reference to FIG. 24. As a determination reference of this embodiment, there is a method in which pitch emphasis is not performed when periodic background noise is mixed in an input signal while pitch emphasis is performed when non-periodic background noise is mixed in an input signal.

An input signal (block) a(n) is inputted (in a step S701), and the power of the background noise of the input signal is analyzed (in a step S702). Further, in a step S703, determination as to whether an input signal is directly coded (in a step S707) or the processing goes to a next step S704 is made, depending on the threshold value S of the power of the background noise. Specifically, when the power of the background noise is greater than the threshold value S (e.g., 20 dB is preferable), a switch 510 is instructed (commanded) so as to directly code an input signal a(n). When the power of the background noise is smaller than the threshold value S, the pitch gain of the background portion is analyzed in the step S704, and the target to be coded is switched depending on whether the analyzed pitch gain is greater or smaller than a threshold value G' (in a step S705). This means, when the pitch gain is greater than the threshold value G', the switch 510 is instructed so as to directly code an input signal a(n) (in a step S707). When the pitch gain is smaller than the threshold value G', the switch 510 is instructed so as to code a pitch emphasis signal obtained by emphasizing an input signal in units of pitch period (in a step S706). Whether a pitch emphasis signal is coded or an input signal a(n) is directly coded is thus determined depending on the pitch gain of the background portion, because a coded signal which is slightly difficult to hear is decoded in the decoding side if pitch emphasis is performed when signal components forming the background portion have a certain periodicity.

Figures 25, 26:
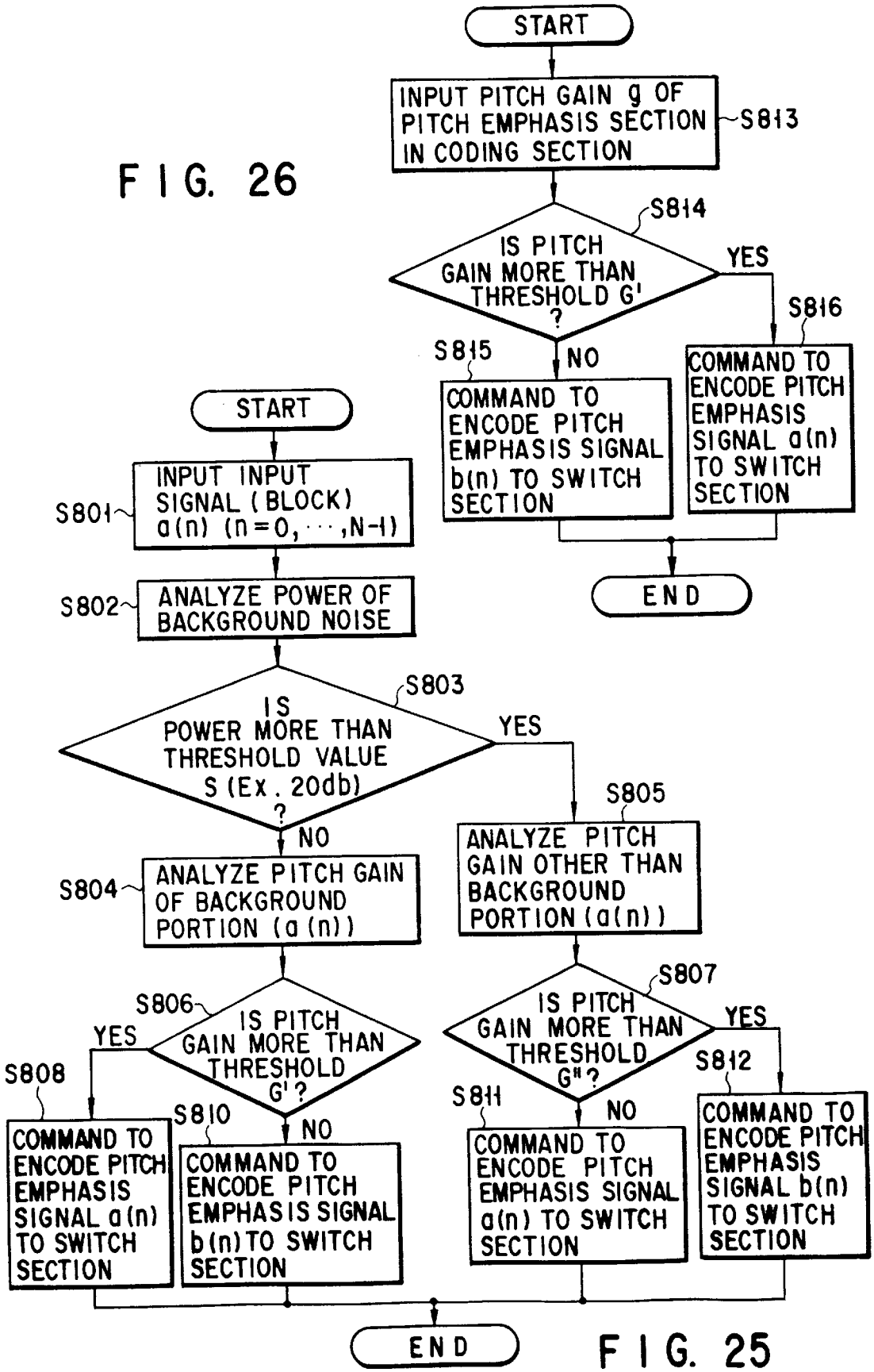
FIG. 25 is a flow-chart showing the processing in the determine section of the ninth embodiment of the present invention.
FIG. 26 is a flow-chart showing the processing in the determine section of the tenth embodiment of the present invention.

Explanation of another operation of the determining section 500 will be explained with reference to FIG. 25. As a determination reference of this embodiment, there is a method in which pitch emphasis is not performed when an input signal does not include much pitch information, e.g., with respect to a non-sound portion or a non-voice portion, while pitch emphasis is performed when an input signal includes much pitch information, e.g., with respect to voice portion.

An input signal (block) a(n) is inputted (in a step S801), and the power of the background noise of the input signal is analyzed (in a step S802). Further, in a step S803, whether to go to a step S805 or to go to a step S804 is determined depending on the threshold value S of the background noise. Specifically, analysis of the pitch gain of the other portion than the background portion is performed when the power of the background noise is greater than the threshold value S (e.g., 20 dB is preferable), while the pitch gain of the background portion is analyzed in the step S804 when the power of the background noise is smaller than the threshold value S. When the pitch gain of the portion other than the background portion is smaller than the threshold value G", the switch 510 is instructed so as to directly code an input signal a(n) (in a step S8101). When the pitch gain is greater than the threshold value G", the switch is instructed so as to code a pitch emphasis signal obtained by emphasizing the pitch of an input signal (in a step S812). Meanwhile, when the pitch gain is greater than the threshold value G" as a result of analysis of the background portion, the switch 510 is instructed so as to directly code an input signal a(n) (in a step S808). When the pitch gain is smaller than the threshold value G", the switch 510 is instructed so as to code a pitch emphasis signal obtained by emphasizing an input signal in units of pitch period (in a step S810). Whether a pitch emphasis signal B(n) is coded or an input signal a(n) is directly coded is determined depending on the pitch gains of the background portion and the portion other than the background portion, because a coded signal which is slightly difficult to hear is decoded in the decoding side if pitch emphasis is performed when a background portion has a constant periodicity.

Figure 36:
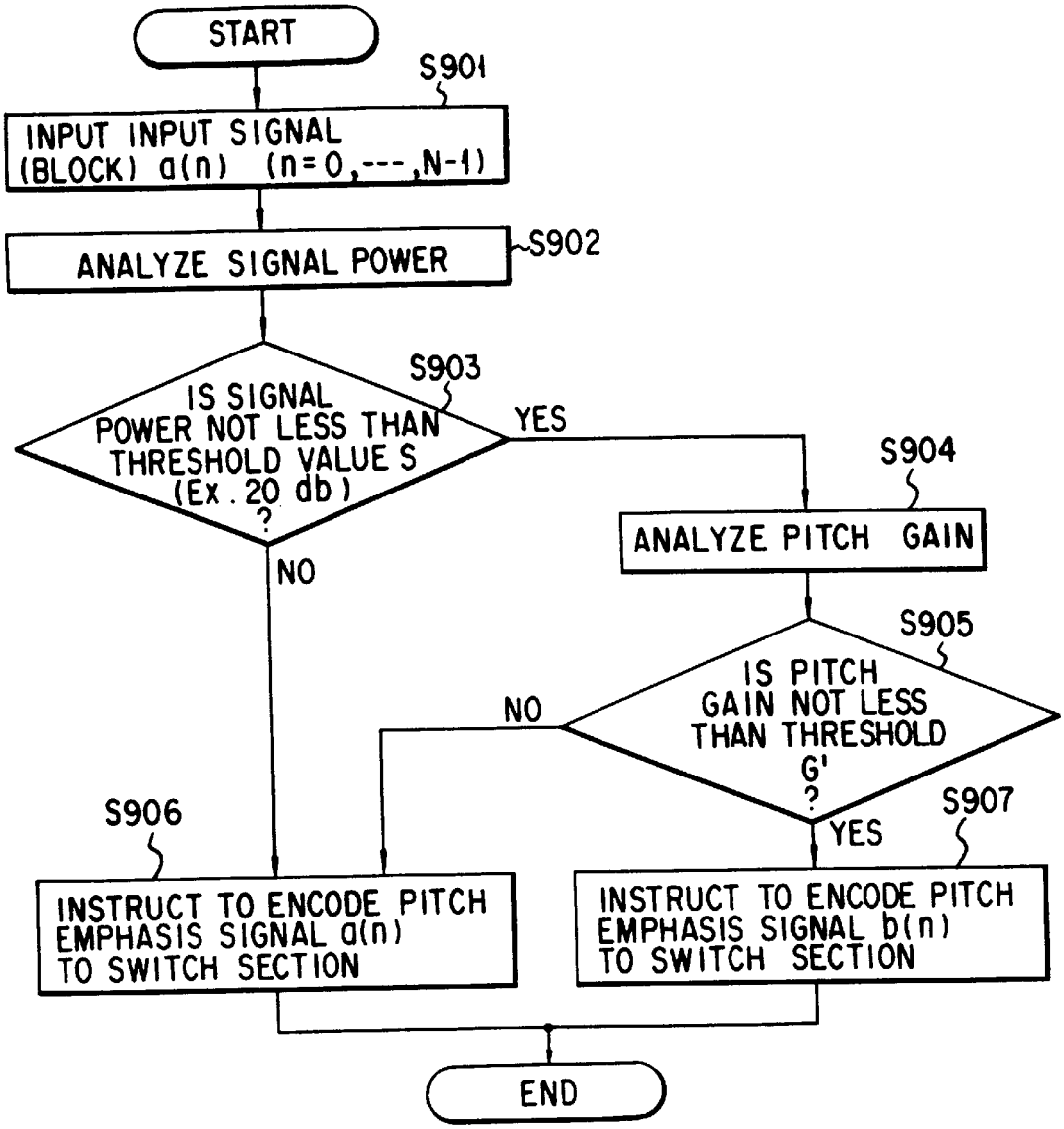
FIG. 36 is a flow-chart showing the processing in the determine section of a modification example of the tenth embodiment of the present invention.

In addition, with respect to speech which has already been recognized as not substantially including background noise, there is a method in which pitch emphasis is not performed when much pitch information is not included in an input signal, e.g., with respect to a non-sound portion and a non-voice portion, while pitch emphasis is performed when much pitch information is included in an input signal, e.g., with respect to a speech portion. This method will be explained with reference to FIG. 36. This method ensures a merit that determination conditions depending on background noise are not necessary and that whether pitch emphasis should be performed or not is determined by much simpler procedures.

An input signal (block) a(n) is inputted (in a step 901), and the power of the input signal is analyzed (in a step 902). Further, in a step 903, whether to go to a step 904 or to go to a step 906 is determined depending on a threshold value S of the signal power. Specifically, pitch analysis of the input signal is performed when the power of the background noise is greater than the threshold value S (e.g., 20 dB is preferable), while the switch 510 is instructed so as to code the input signal a(n) in a step 906 when the power of the background noise is smaller than the threshold value S. The processing goes to a step 907 when the pitch gain obtained in the step 904 is greater than a threshold value G', while the processing goes to the step 906 when the pitch gain is smaller than the threshold value G'. This means, the switch 510 is instructed so as to code a pitch emphasis signal in the step 907 when the pitch gain is greater than the threshold value G', while the switch 510 is instructed so as to code the input signal a(n) when the pitch gain is smaller than the threshold value G'.

Figure 21:
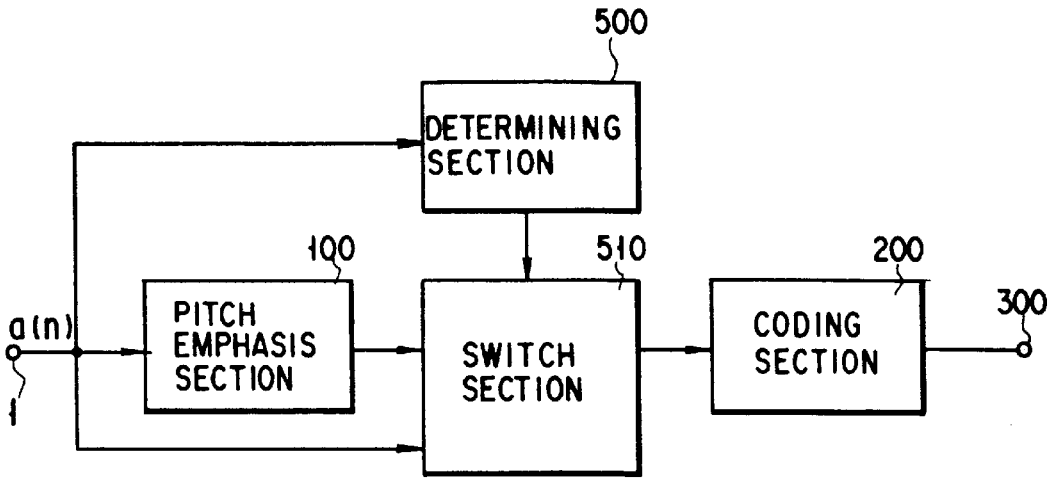
FIG. 21 is a block diagram of a coding apparatus capable of switching a pitch emphasis signal and an input signal in coding, according to a ninth embodiment.
Figure 30:
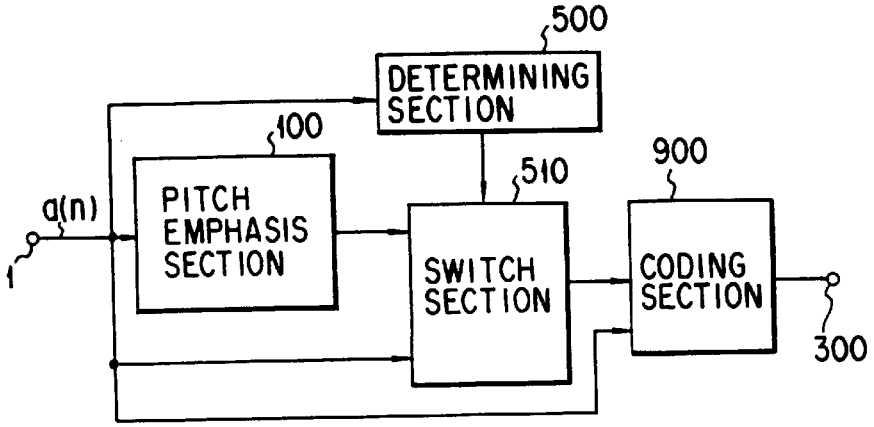
FIG. 30 is a block diagram showing a modification example of the ninth embodiment of the present invention.

FIG. 30 shows a structure in which LPC analysis is performed with use of an input signal a(n), in order to obtain an LPC coefficient which expresses an accurate spectrum envelope on the basis of the structure shown in FIG. 21.

Figure 31:
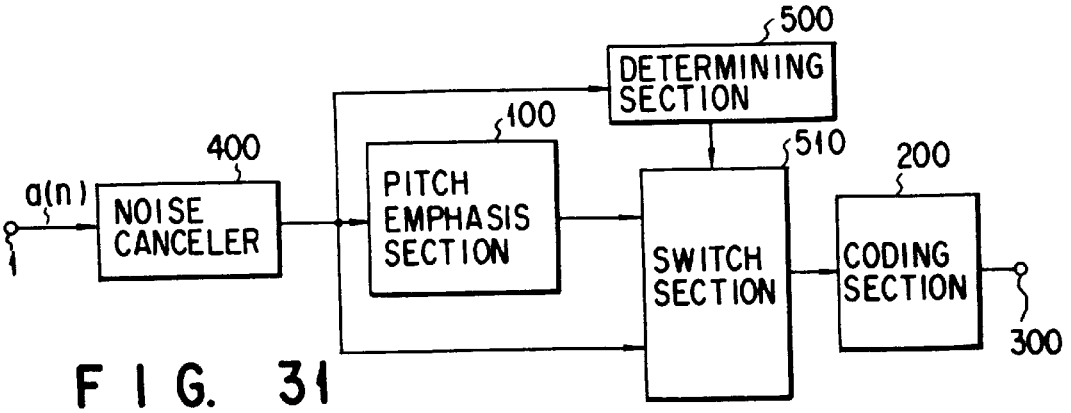
FIG. 31 is a block diagram showing a modification example of the ninth embodiment of the present invention.
Figure 32:
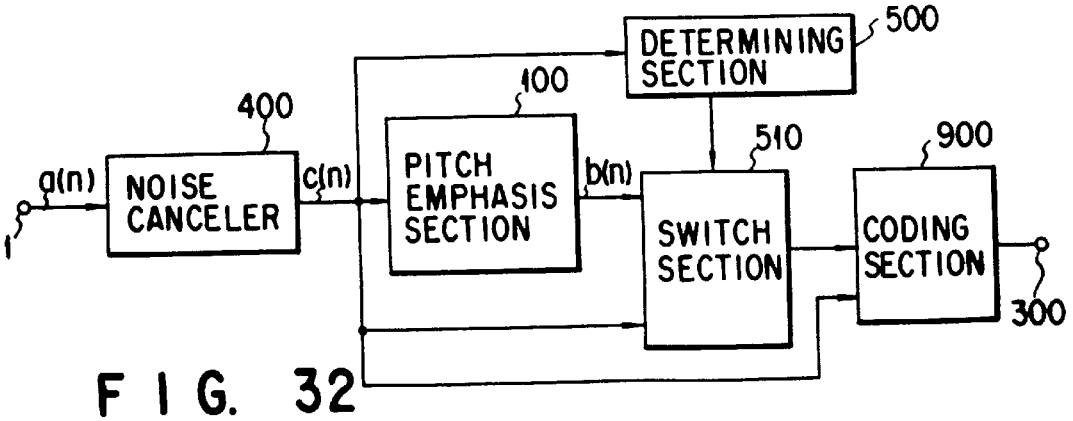
FIG. 32 is a block diagram showing a modification example of the ninth embodiment of the present invention.

Further, FIG. 31 shows a structure in which a noise canceler is combined with the structure of FIG. 21, and FIG. 32 shows a structure in which a noise canceler is combined with the structure of FIG. 30.

A speech coding apparatus according to a tenth embodiment of the present invention will be explained with reference to FIG. 22. Note that those components of FIG. 22 which are referred to by the same numbers of FIG. 11 are defined as having the same functions of those of FIG. 11, and explanation thereof will be omitted.

This embodiment is different from the ninth embodiment in that determination as to whether a signal obtained by emphasizing the pitch of an input signal is coded or an input signal is directly coded is made by a determining section 520, depending on a signal from a pitch emphasis section 100. On the basis of a result determined by the determining section 520, the determining section 520 supplies an instruction to the switch 510.

Operation of the determining section 520 in FIG. 22 will be explained with reference to FIG. 26. A pitch gain g obtained by a pitch analysis computation section 101 of a pitch emphasis section 100 is inputted (in a step S813), and in a step S814, the pitch gain g determines whether a pitch emphasis signal obtained by emphasizing an input signal in units of a pitch period is coded (in a step S815) or an input signal a(n) is directly coded (in a step S816), depending on the threshold value S of the power.

Figure 22:
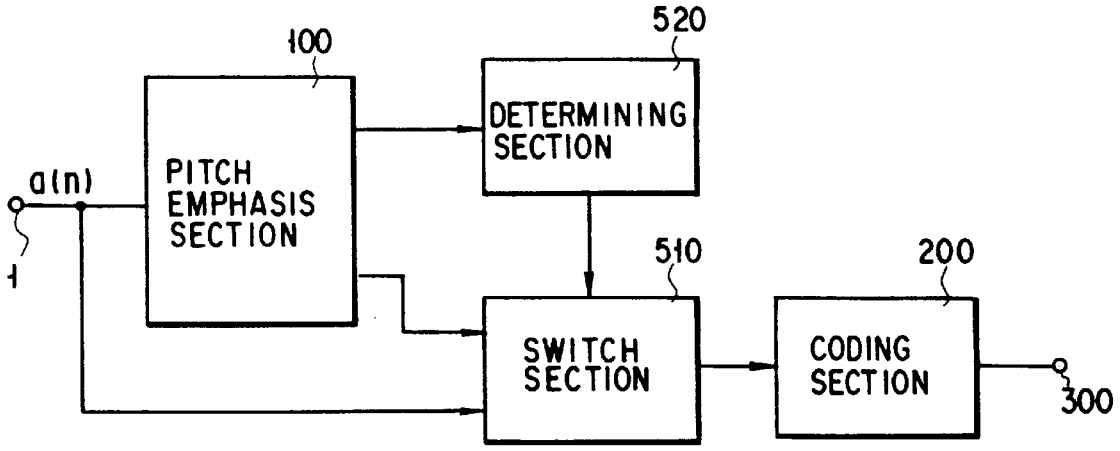
FIG. 22 is a block diagram of a coding apparatus capable of switching a pitch emphasis signal and an input signal in coding, according to a ninth embodiment.
Figure 33:
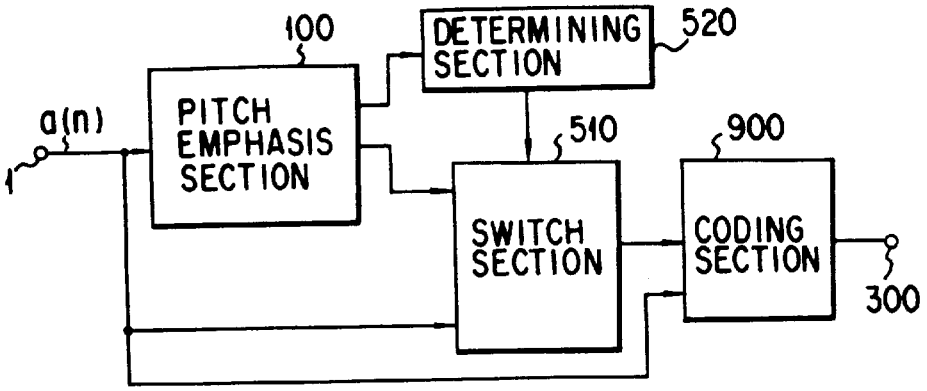
FIG. 33 is a block diagram showing a modification example of the tenth embodiment of the present invention.
Figure 34:
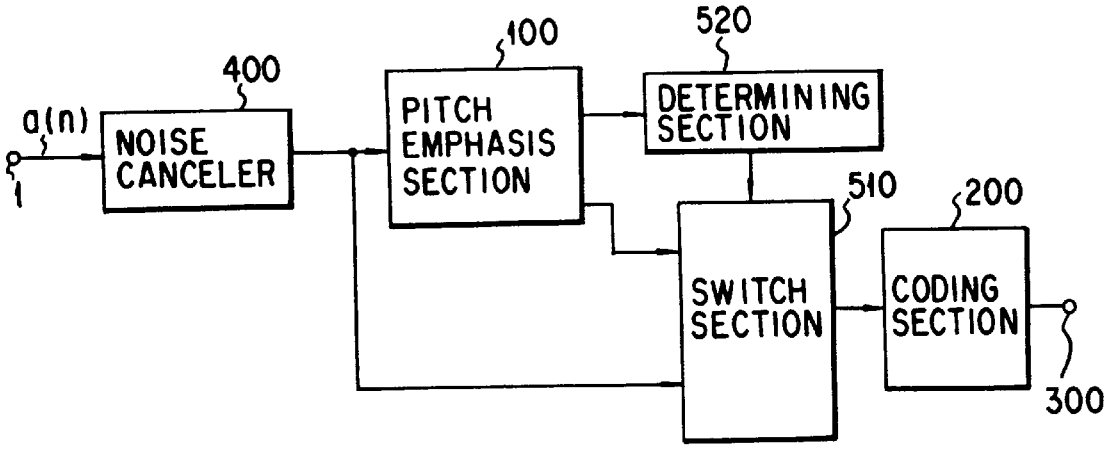
FIG. 34 is a block diagram showing a modification example of the tenth embodiment of the present invention.
Figure 35:
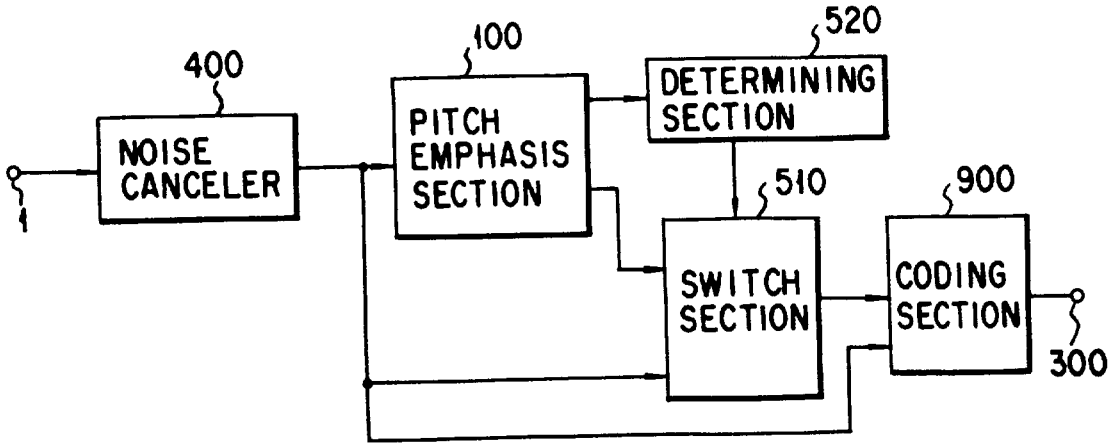
FIG. 35 is a block diagram showing a modification example of the tenth embodiment of the present invention.

FIG. 33 shows a structure in which LPC analysis is performed with use of an input signal a(n), in order to obtain an LPC coefficient which expresses an accurate spectrum envelope on the basis of the structure shown in FIG. 22. Further, FIG. 34 shows a structure in which a noise canceler is combined with the structure of FIG. 22, and FIG. 35 shows a structure in which a noise canceler is combined with the structure of FIG. 35.

Figure 47:
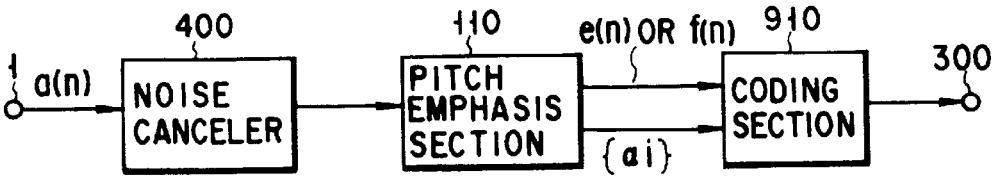
FIG. 47 is a block diagram of a coding apparatus with a noise canceler connected to a pitch emphasis section, according to a twelfth embodiment.
Figure 49:
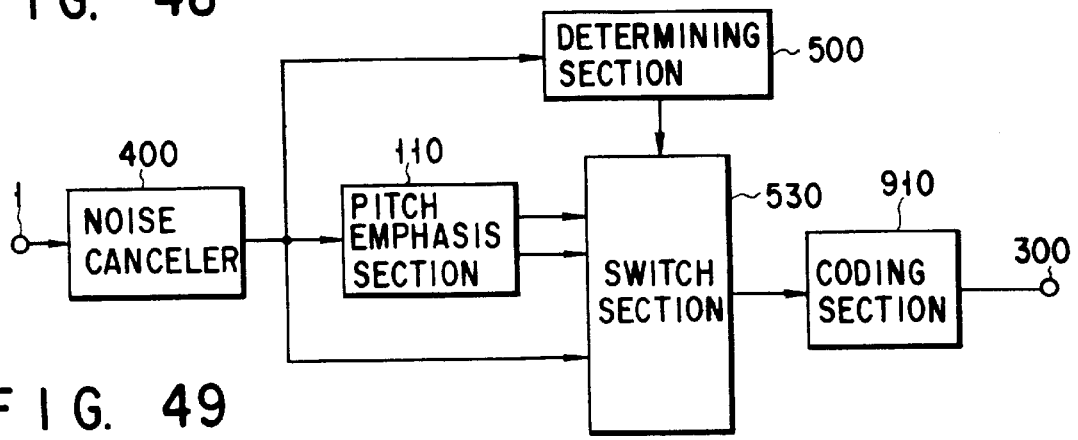
FIG. 49 is a block diagram of a coding apparatus capable of switching a pitch emphasis signal and an input signal in coding, according to a fourteenth embodiment.
Figure 51:
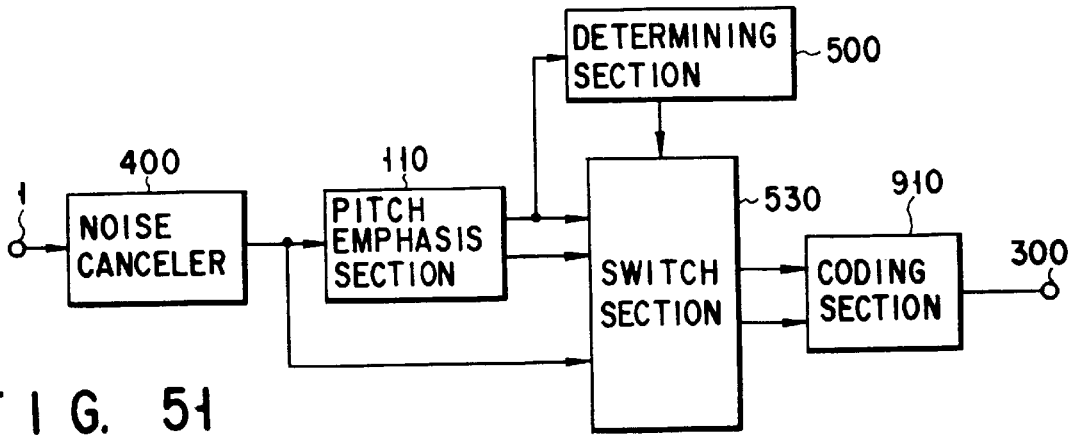
FIG. 51 is a block diagram of a coding apparatus capable of switching a pitch emphasis signal and an input signal in coding, according to a sixteenth embodiment.

The following FIGS. 47, 49 and 51 show structures in which a noise canceler 400 is combined with a determining section 500 or 520, on the basis of a pitch emphasis section 110 and a coding section 910.

FIG. 47 shows a structure in which a noise canceler 400 is combined with the structure of FIG. 46.

Figure 48:
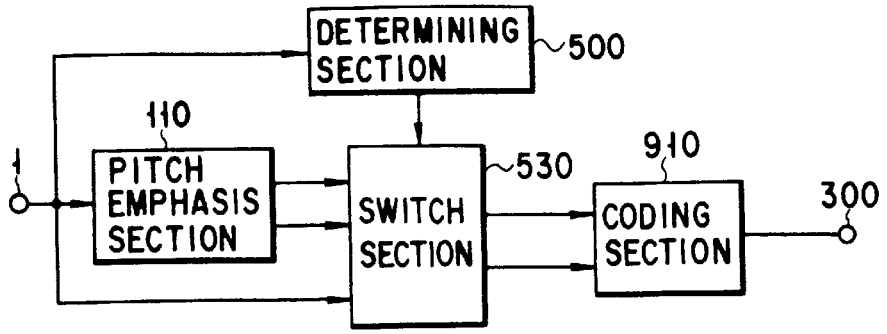
FIG. 48 is a block diagram of a coding apparatus capable of switching a pitch emphasis signal and an input signal in coding, according to a thirteenth embodiment.

FIG. 48 shows a structure based on FIG. 46, in which a determining section 500 determines whether an input signal is analyzed and an output signal of a pitch emphasis section 110 is coded by a coding section 910, or an input signal is coded by a coding section 910. A switch 530 outputs a pitch emphasis signal outputted from the pitch emphasis section 110 or an input signal, on the basis of the determination result from the determining section 500. In addition, an LPC coefficient outputted from the pitch emphasis section 110 is always outputted from a switch 530 and supplied to a coding section 910.

Figure 50:
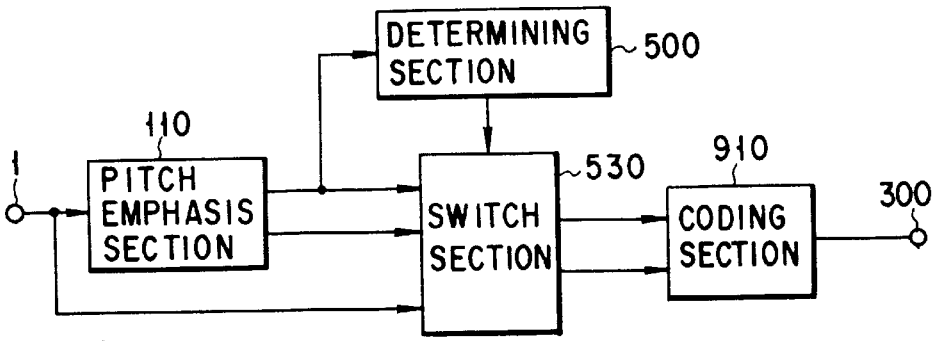
FIG. 50 is a block diagram of a coding apparatus capable of switching a pitch emphasis signal and an input signal in coding, according to a fifteenth embodiment.

FIG. 49 shows a structure in which a noise canceler 400 is combined with FIG. 48. FIG. 50 shows a structure substantially equivalent to FIG. 48, except that a signal analyzed by the determining section 500 is a pitch emphasis signal as an output from the pitch emphasis section 110. FIG. 51 shows a structure in which a noise canceler 400 is combined with the structure of FIG. 50.

As has been explained above, according to the speech coding apparatus of the present invention, pitch emphasis is previously performed before coding an input signal, and therefore, sufficient pitch information can be obtained in the side of a decoder even if pitch information is lost to a certain extent during coding procedures, so that subjective quality is improved.

A storage/transfer apparatus for coded data according to a seventeenth embodiment will be explained with reference to the drawings.

Figure 52:
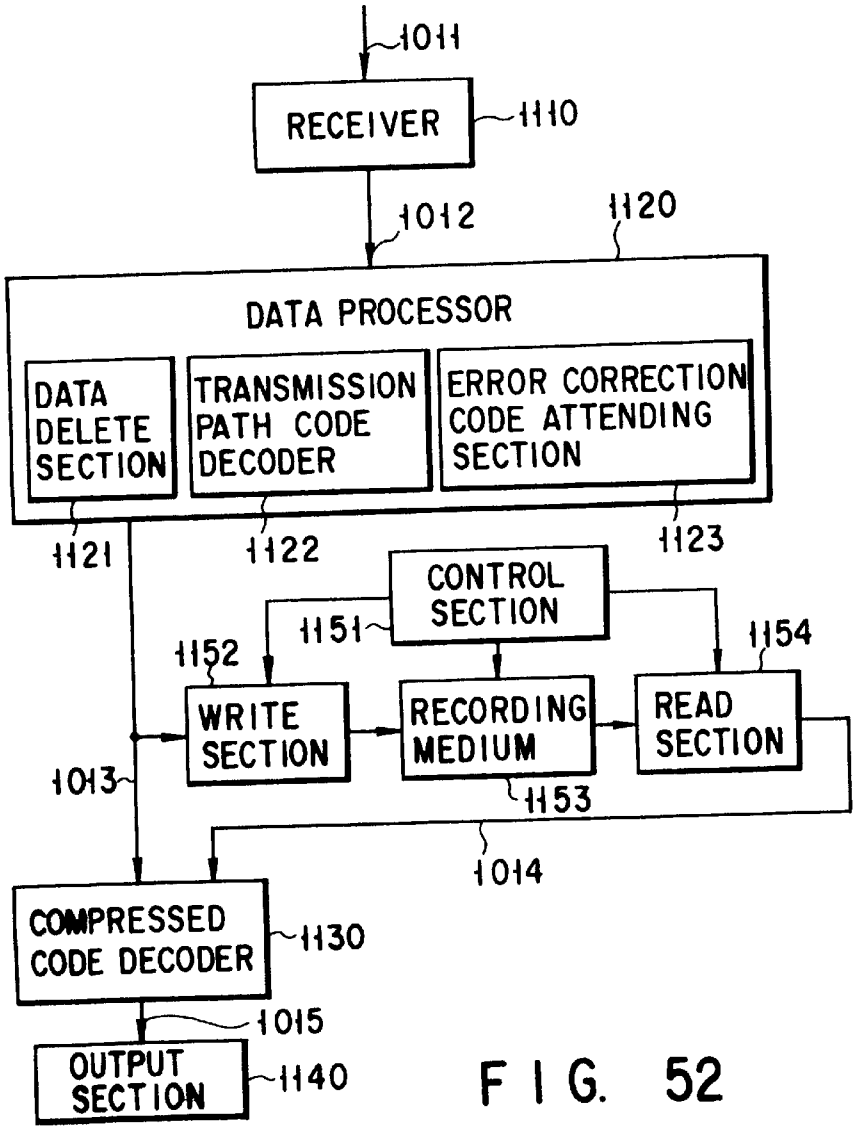
FIG. 52 is a block diagram showing the structure of an apparatus for storing and transferring coded data according to the seventeenth embodiment of the present invention.

The storage/transfer apparatus shown in FIG. 52 comprises a receive section 1110 for receiving coded data transferred, a processor 1120 for processing coded data thus received, a compression encoder/decoder 1130 for expanding a compression code of the coded data thus processed (i.e., for releasing compression thereof) and for decoding the coded data to generate reproduced data, an output section 1140 for outputting the reproduced data, a controller 1151 for removing data unnecessary for storage/transfer and for controlling writing, storing, and reading of coded data added with necessary data, a write section 1152 for performing writing of coded data for storage/transfer, a storage section 1153 for storing coded data to be written, and a read section 1154 for reading stored coded data, on the basis of control by the controller 1151 when reading of coded data is necessary.

Data dealt with by a storage/transfer apparatus for coded data having the above structure will be explained below, divided into a case of storing data and a case of reproducing data.

Figure 53:
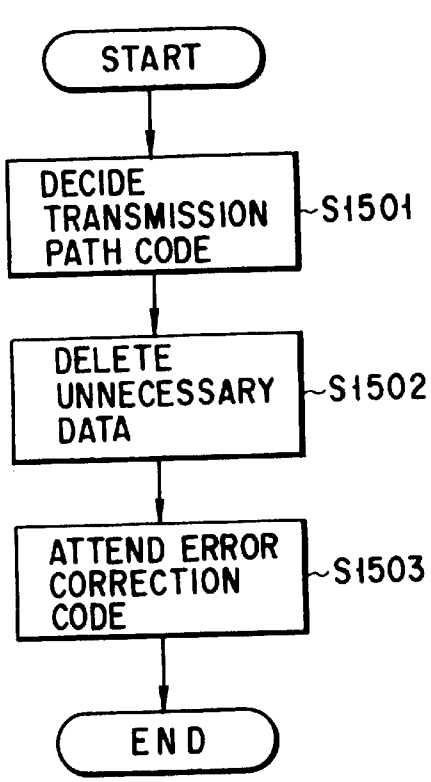
FIG. 53 is a flow-chart for explaining operation of a data processing section.
Figure 54:
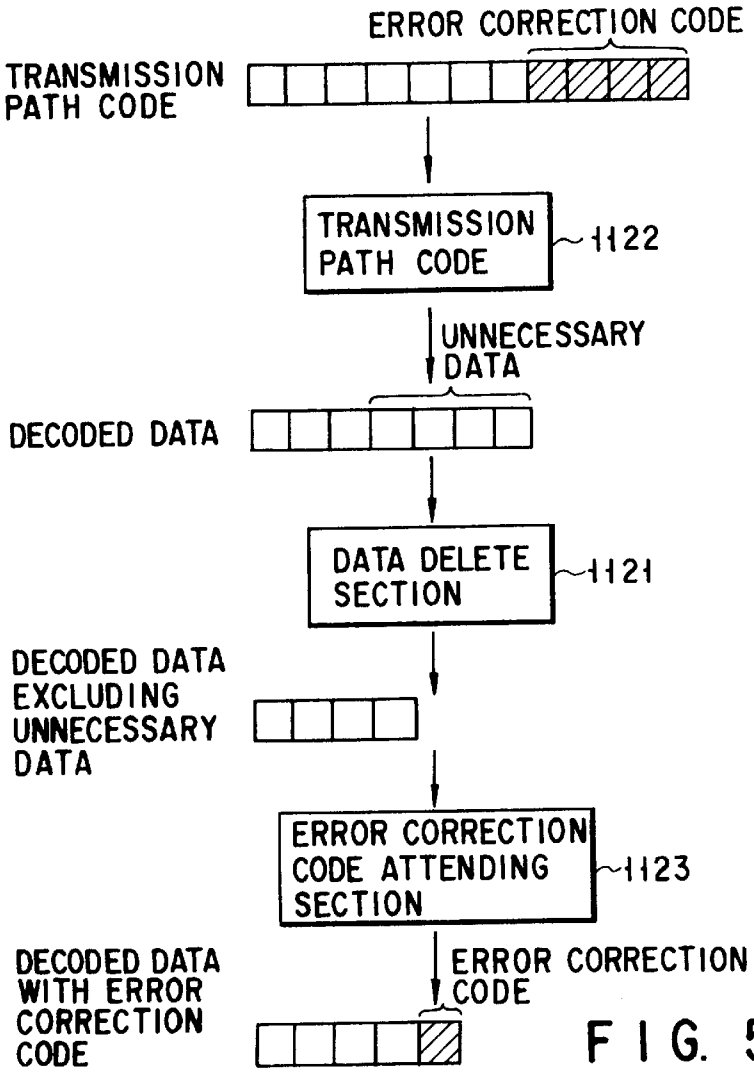
FIG. 54 is a figure specifically explaining operation of the data processing section.

When storing data, received data 1011 is sent to a receive section 1110, and is thereby converted into transfer path coding data 1012 including a transfer path code. The transfer path coding data 1012 is sent into a data processor 1120 where a transfer path code is decoded and data deletion is performed by a transfer path code decoder 1122 and a data delete section 1121 which constitute the data processor 1120. The data is then outputted as compression coding data 1013. Specifically, as shown in the flow-chart of FIG. 53, a transfer path code included in the transfer path coding data is decoded after the start of the chart (in a step S1501), and then, unnecessary data is deleted from the data (in a step S1502). Thereafter, the data after the delete processing is added with an error correction code, thus completing processing in the data processor 1120. To specifically explain the above data processing, a transfer path code is decoded by a transfer path encoder as shown in FIG. 54, and decoded data from which an error correction code is deleted as also shown in this figure is formed thereby. This data includes unnecessary data, and the unnecessary data is deleted by the data delete section 1121, while decoded data including only necessary data is outputted from the data delete section 1121. This decoded data inputted into an error correct code adder 1123, and an error correct code is added to the decoded data. In this manner, decoded data of the processed transfer path coding data is outputted as compression coding data 1013 from the error correct code adder 1123.

The compression coding data 1013 from the data processor 1120 is stored in a recording medium 1153 by a writing section 1152 in accordance with an instruction from the controller 1151. When reproducing data, compression coding data stored in the recording medium 1153 with at least the transfer path code being deleted therefrom is read out from the reading section 1154 and is decoded by a compression code decoder 1130, so that the data is supplied as reproduced data 1015 to a user through an output section 1140.

As has been described above, transfer path coding data 1012 is outputted from the receive section 1110, and the transfer path coding data 1012 is subjected to compression coding of data such as speech and images in the side of a receiver. Thereafter, the transfer path coding data is added with an error detect code, an error correct code, and an interleave. In the transfer path code decoder 1122 included in the data processor 1120, de-interleaving, error correct decoding, and error detect decoding are performed, and the result is outputted as compression coding data. In this stage, depending on the scheme of the transfer path coding, an error detect bit indicating the result of error detection is outputted in some cases, independently from the compression coding data. In case where an error detect bit is outputted, there is provided a system in which the error detect bit is monitored by the compression code decoder 1130, and compensation processing is performed when detecting an error, so that the quality of reproduction data 1015 is not deteriorated.

As for a method of storing the error detect bit, two methods can be proposed. The first one is a method of storing an error detect bit together with compression coding data 1013. The second one is a method of storing compression coding data 1013 after having performed compensation processing on the basis of an error detect bit. In the second method, if a reproduction device 1202 is separately provided, it is possible to obtain reproduction data 1026 which is substantially equivalent to that obtained where compensation processing is performed without providing the compression code decoder 1230 with a function of performing compensation processing. However, depending on the compensation method, it is necessary to perform compensation, such as interpolation processing for reproduction data 1226. In this case, since reproduction data 1226 is necessary for compensation processing, in addition to the compression coding data 1223, it is principally impossible to perform compensation only by operating compression coding data 1223, so that the second method cannot be used.

In some cases, an unnecessary portion is deleted from data decoded by the transfer code decoder 1222 by the data delete section 1221 included in the data processor 1220. This is because, for example, with respect to compression coding data subjected to layered coding or the like, all the compression coding data 1213 need not be stored/transferred in several cases, depending on the resolution of a reproduction apparatus to be used. Another example thereof will be a case of recording speech data such as contents of telephone conversation. In this case, the original object of recording the contents of telephone conversation is not influenced even if a non-sound period or a background noise period is deleted. In addition, in an error correct coding adder 1223, data decoded by a transfer path code decoder 1222 is added with an error correct code of a small size. This is because a light error may occur in storage or transfer of data, and therefore, data can be protected without substantially influencing the data amount and the calculation amount when reproducing the data, by adding a simple error correct code even though the simple error correct code thus added is not a detect code or a correct code of such a large size as a transfer path code has.

The transfer code decoder 1222, the data delete section 1221, and the error correct code adder 1223 may have various relationships between each other. There is a case in which data deletion is performed after decoding a transfer path code as described above. Otherwise, transfer path code decoding may be performed after data deletion. In addition, there is a case in which the error correct code adder deals with data immediately after transfer path code decoding, and in another case, the error correct code adder deals with data once subjected to data deletion. In addition, there is a case in which data deletion or addition of an error correct code is not performed. The relationship between these three components may therefore be determined, depending on the compression coding scheme, the transfer path coding scheme, the specifications of the storage/transfer apparatus and the reproduction apparatus.

Compression coding data 1213 (sometimes including an error detect bit) thus obtained is written into a storage medium 1253 by a writing section 1252, in accordance with an instruction of the control section 1251. A semiconductor memory, a magnetic disc, an IC card or the like may be used as the storage medium 1253. In addition, if the compression coding data 1213 is simultaneously supplied to the compression code decoder 1230, it is possible to decode the data undergoing a storage operation and to supply the data for a user through the output section 1240. When reproducing data, stored data is outputted as compression coding data 1014 through a reading section 1254, and is decoded by the compression code decoding section 1230. Thereafter, the data is supplied to a user through the output section 1240.

Advantages of a storage/transfer apparatus using the above structure will be explained with reference to several examples. In case of a speech coding standard scheme of a digital portable telephone, the compression coding data is of 3.45 Kbps as described before, and the transfer path coding data is of 5.6 Kbps. When contents of conversation is stored in the receiver side with use of a storage medium consisting of a 1M-bite semiconductor memory, data equivalent to only about 24 minutes is recorded, according to a conventional method of storing transfer path coding data. However, in this case, recording of about 38 minutes can be realized including error detect bits, according to the eleventh embodiment of the present invention where the data processor includes only a transfer path decoding means, and this recording time is longer by 14 minutes than the conventional method. In addition, as for the calculation amounts in the receiver side, the calculation amount of the transfer path code decoder is two or three times larger than the calculation amount of the compression code decoder. Therefore, reproduction according to this embodiment can be achieved with a calculation amount of ⅓ to ¼ of a conventional storage/transfer apparatus, so that a corresponding electric power consumption can be saved thereby lengthening the battery life.

Figure 55:
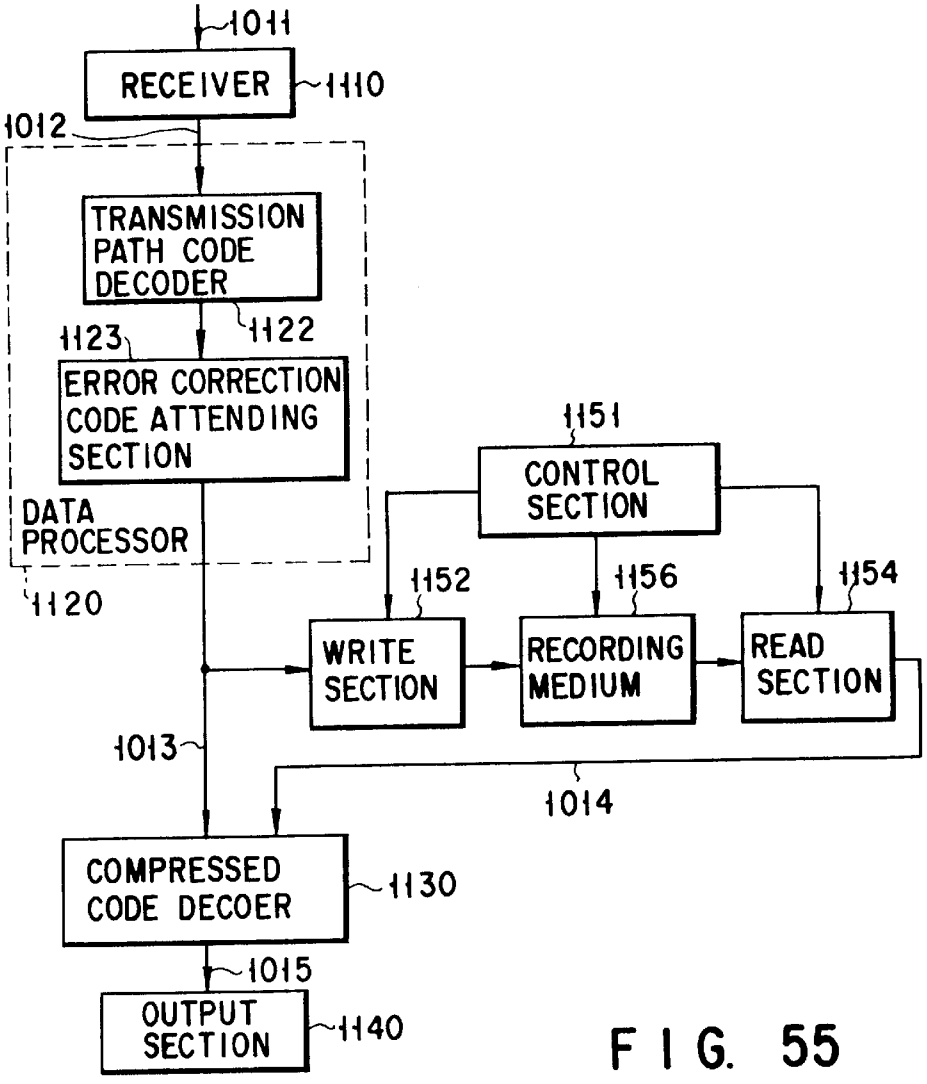
FIG. 55 is a block diagram showing the structure of an apparatus for storing and transferring coded data according to the eighteenth embodiment of the present invention.

FIG. 55 is a block diagram showing the structure of a storage/transfer apparatus for coding data according to an eighteenth embodiment of the present invention. This twelfth embodiment restricts processing procedures of a data processor in the seventeenth embodiment shown in FIG. 52. Transfer path code data 1012 is decoded by a transfer path code decoder 1222, and is thereafter added with an error correct code by an error correct code adder 1223.

A storage/transfer system in which data is stored/transferred in a storage medium such as a hard disc or a semiconductor memory cannot avoid occurrence of a bit error although this kind of system achieves a lower occurrence probability in comparison with a transmitter system. Although the occurrence probability of a bit error is thus lower in a storage/transfer system, occurrence of a bit error cannot be neglected, in order to correctly read data stored. According to the structure of this eighteenth embodiment, a small size error correct code for protecting data from a light error which may occur in a storage/transfer system is added after removing a transfer path code for protecting data from a heavy code error which may occur in a transfer path, and as a result, data can be protected from an error in a storage/transfer system, with only an increase of minimum bits required.

In addition, an increase in number of bits can be restricted to be much smaller by using a code optimum for the characteristics of a storage/transfer system when adding an error correct code.

Figure 56:
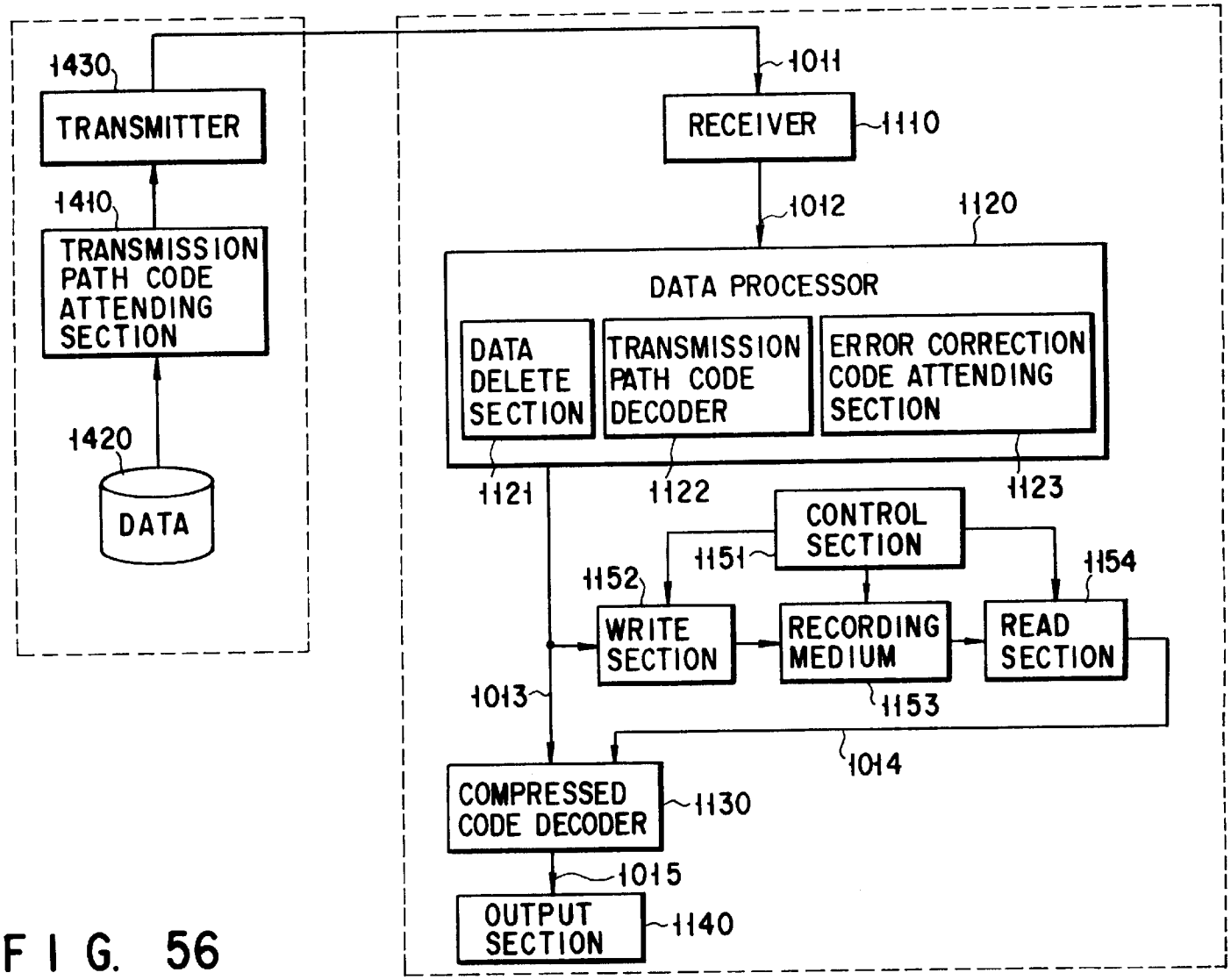
FIG. 56 is a block diagram showing the structure of an apparatus for storing and transferring coded data, together with the structure of a transmit apparatus, according to the nineteenth embodiment of the present invention.

FIG. 56 is a block diagram showing the structure of a storage/transfer apparatus for coded data according to the nineteenth embodiment of the present invention, in view of the relationship with a transmit apparatus. The structure and operation of a storage/transfer apparatus for coded data are the same as those of the seventeenth embodiment shown in FIG. 52. FIG. 56 discloses a specific structure of the transmit apparatus for transmitting input data of a receive section 1110 of the storage/transfer apparatus. In this figure, the transmit apparatus comprises a transfer code adder 1410 for adding a transfer path code to data to be transmitted, a storage section 1420 for storing the data to be transmitted, and a transmit section 1430 for transmitting compression coding data added with a transfer path code toward the transfer path.

The storage/transfer apparatus for coded data, according to the nineteenth embodiment shown in FIG. 56, is provided with a transfer path code adder 1410 for protecting data from occurrence of a large error in a transfer path, and is simultaneously provided with a data processor 1220 so as to correspond to the adder 1410 through the transfer path. In the transmitter side, the transfer path code adder 1410 adds a transfer path code before transmitting and then transmits data, in order to protect data in the transfer path. In the receiver side, the data processor 1220 partially decode the transfer path code, with only an error correct code for storage and transfer being left and removed, thereby reducing the data amount to be stored and transferred. As a result of this, an advantage is obtained in that data for storage and transfer is obtained without adding any new error correct code. In addition, for example, if a plurality of kinds of transfer path codes to be added are prepared in the adder 1410 in the transmitter side in compliance with the structure of a storage system such as the kind of a storage, the storage efficiency of the storage/transfer system can be much more improved.

Figure 57B:
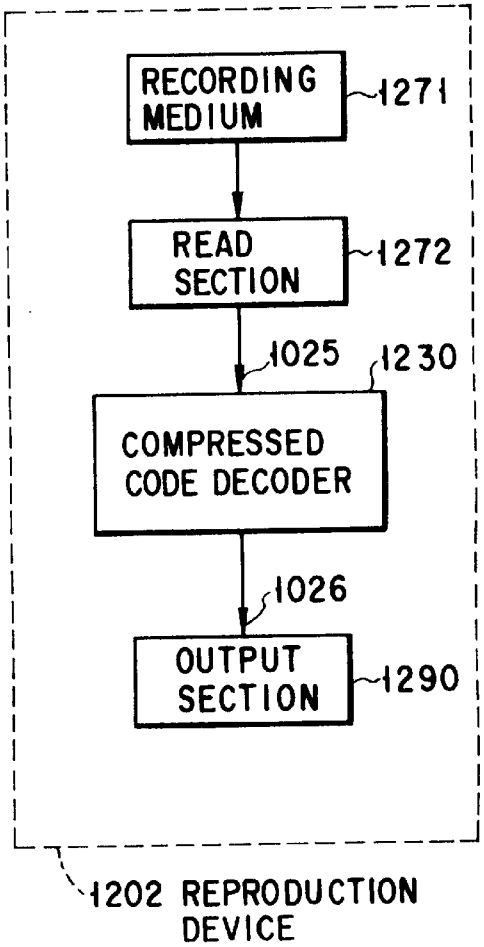
FIGS. 57A and 57B are block diagrams showing the structure of an apparatus for storing and transferring coded data, together with the structure of a transmit apparatus, according to the twentieth embodiment of the present invention.
Figure 57A:
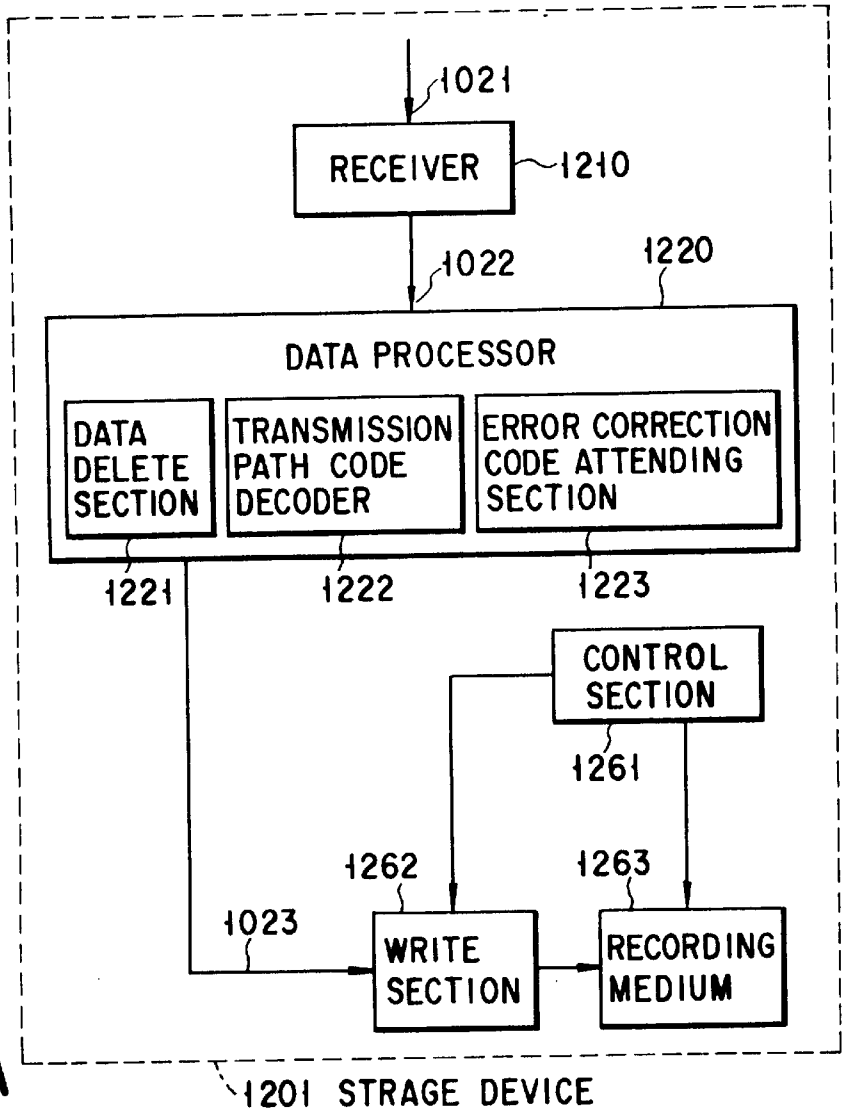

FIGS. 57A and 57B are block diagrams showing a relational structure between a storage/transfer apparatus and a reproduction apparatus for coded data, according to the twentieth embodiment of the present invention. This embodiment is different from the eleventh embodiment in that a reproduction apparatus 1202 is provided independently from a storage apparatus 1201. In the storage apparatus 1201, compression coding data 1023 outputted from a data processor 1220 is stored into a storage medium 1263 by a writing section 1262, in accordance with an instruction of a controller 1261. In the reproduction apparatus 1202, data stored in the storage medium 1271 is read out from the reading section 1272, and is outputted as compression coding data 1025, which is decoded by the compression code decoder 1280 and is supplied as reproduction data 1026 to a user through an output section 1290. In a conventional method in which transfer path code decoder 1222 is stored in the storage medium 1263, the reproduction apparatus 1202 requires a transfer path code decoder 1222 and a compression code decoder 1280. Meanwhile, according to the structure of this twentieth embodiment, the reproduction apparatus 1202 does not require a transfer path code decoder 1222, and therefore, it is possible to reduce the circuit scale of the reproduction apparatus 1202 or to save electric power consumption.

Figure 58B:
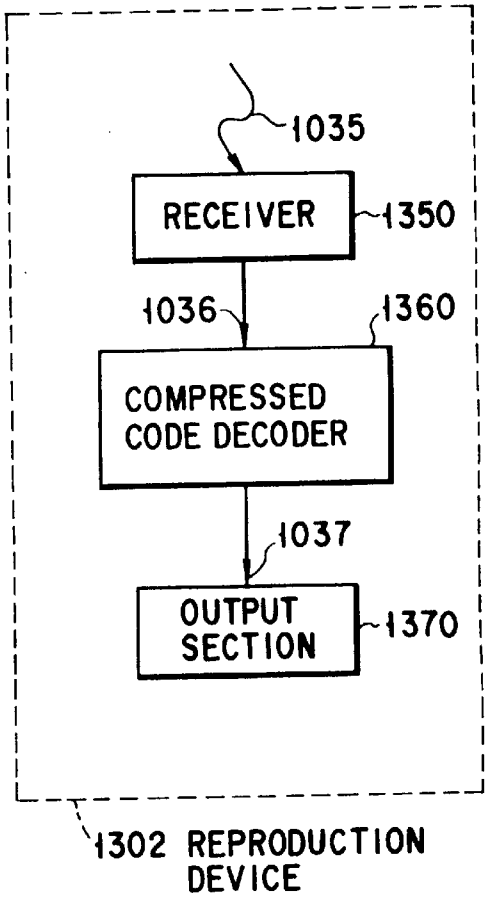
FIGS. 58A and 58B are block diagrams showing the structure of an apparatus for storing and transferring coded data, together with the structure of a transmit apparatus, according to the forty embodiment of the present invention.
Figure 58A:
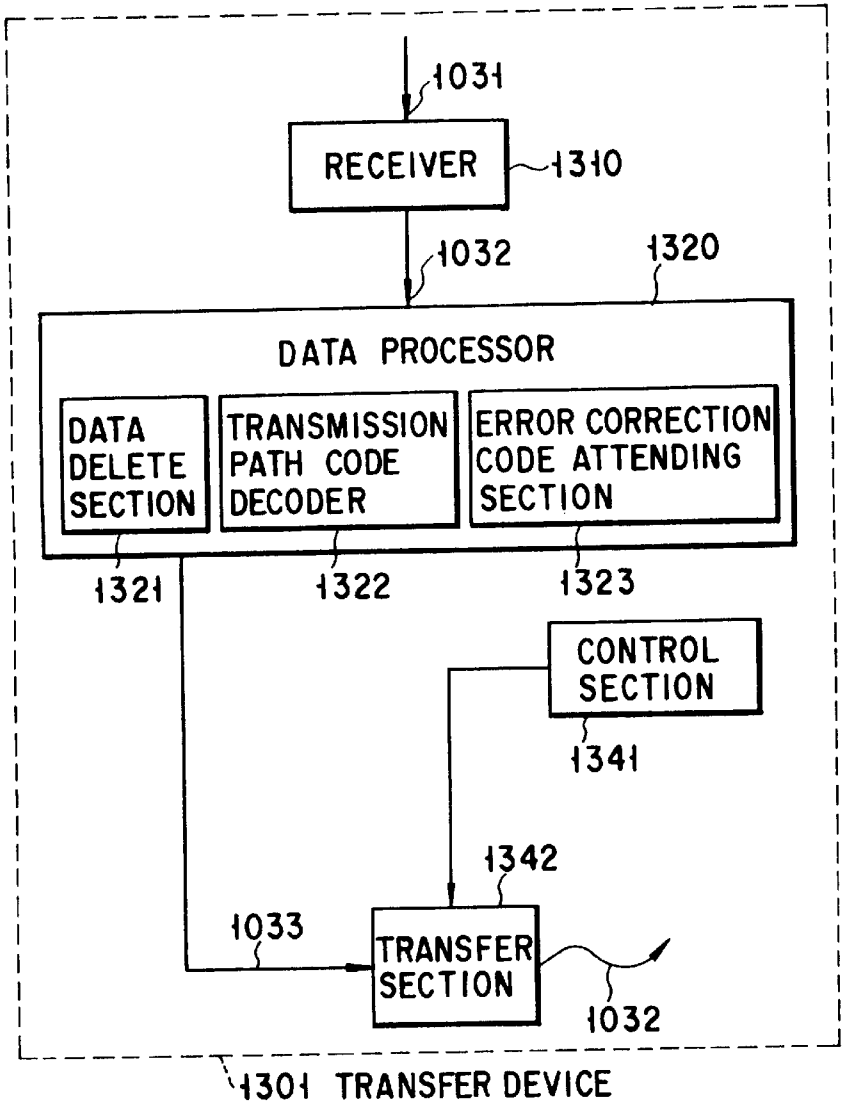

FIGS. 58A and 58B are block diagrams showing relational structures of a storage/transfer apparatus for coded data according to the twenty-first embodiment of the present invention and a reproduction apparatus connected thereto. The fifteenth embodiment is different from the fourteenth embodiment in that the transfer apparatus 1301 comprises a transfer section 1342 in place of a writing section 1262 and a storage medium 1263 and that the reproduction apparatus 1302 comprises a receive section 1350 in place of a reading section 1272 and a storage medium 1271. Compression coding data outputted from a data processor 1320 is outputted to a transfer path by the transfer section 1342. The reproduction apparatus 1302 receives the transferred data 1035 by means of the receive section 1350, and decodes the data by means of the compression code decoder 1360. Thereafter, the decoded data is supplied to a user through an output section 1370. In the fifteenth embodiment, it would be more advantageous to make an arrangement that data decoded by the transfer path code decoder 1322 is added with a simple error correct code by an error correct code adder 1323 to protect data from an error when transferring data. Further, in case where data is transferred to a number of reproduction apparatuses 1302 through a network or the like, the reproduction apparatus 1302 of this fifteenth embodiment need not be provided with a transfer path code decoder 1322, and therefore, it is possible to reduce the circuit size or to reduce electric power consumption. As a result of this, it is possible to lower the costs for the reproduction apparatus 1302, so that a number of reproduction apparatuses 1302 can be used at a low price.

As has been explained above, according to the embodiments of the present invention, when transferred coded data added with a transfer path code by a transmitter system is stored/transferred into a storage means in a receiver system, a transfer path code or the like which is unnecessary for storage and transfer is decoded thereby performing data deletion with respect to received coded data, and an error correct code of a small size for preventing break-down of data during storage/transfer is added to the data. Thereafter, coded data is stored into a storage system or transferred to a transfer system. In this manner, efficient storage/transfer is realized and the application efficiency of a storage medium and a transfer path can be improved, thereby attaining an advantage in that the circuit size of the reproduction apparatus is reduced and the electric power consumption of the reproduction apparatus is reduced.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A coding apparatus comprising:

an input terminal to which an input signal is supplied;

an adaptive codebook for storing excitation signals as vectors;

a synthesis filter for forming a synthesis signal from the vectors stored in the adaptive codebook;

similarity calculation means for calculating a similarity between the synthesis signal obtained by the synthesis filter and an input signal;

coding scheme determining means for determined one coding scheme from a plurality of coding schemes respectively having coding bit rates different from each other, on the basis of the similarity obtained by the similarity calculation means; and coding means for coding the input signal in accordance with the coding scheme determined.

2. The coding apparatus according to claim 1, which includes pitch analysis means for analyzing a pitch of the input signal to obtain pitch information and designating said adaptive codebook by the pitch information, and wherein said adaptive codebook outputs a reference vector designated by the pitch information to said synthesis filter.

3. The coding apparatus according to claim 1, which includes means for searching all reference vectors stored in said adaptive codebook for a reference vector that the similarity obtained by said similarity calculation means indicates a maximum value, and said coding scheme determining means selects one from among the plurality of coding schemes in accordance with the similarity which is calculated by said similarity calculation means in accordance with the reference value searched by said searching means.

4. The coding apparatus according to claim 1, which includes pitch analysis means for analyzing a pitch of the input signal to obtain pitch information, and means for storing pitch information obtained from a past input signal, said adaptive codebook reads out the reference vector designated by the pitch information to said synthesis filter, said synthesis filter forms a synthesis signal corresponding to a current input signal from the reference vector read out from said adaptive codebook, and said similarity calculation means calculates a similarity between the synthesis signal and the current input signal.

5. The coding apparatus according to claim 1, wherein said coding means includes a plurality of coders of different coding schemes, and means for selecting one from among the plurality of coders in accordance with the coding scheme determined by said determining means.

6. A coding apparatus comprising:

pitch analysis means for analyzing an input signal to detect a pitch period and a pitch gain;

emphasis means for emphasizing the input signal to emphasize signal components contained in the input signal in units of the pitch period, using the detected pitch period and pitch gain; and coding means for coding the input signal emphasized by said emphasis means.

7. The coding apparatus according to claim 6, wherein said pitch analysis means includes means for predicting a current input signal, using an input signal obtained before a predetermined time, to generate a prediction signal, and means for calculating a pitch period and a pitch gain at which a prediction error signal between the prediction signal and the input signal has a maximum power.

8. The coding apparatus according to claim 6, wherein said pitch emphasis means emphasizes the input signal in units of the pitch period in accordance with the following equation to output a pitch emphasized signal;

$$b(n)=G\cdot a(n)+g\cdot\epsilon b(n-T)$$

where G: gain, g: pitch gain, $\epsilon<1$, T: pitch period.

9. A coding apparatus comprising:

LPC analysis means for LPC-analyzing an input signal to detect a pitch period and a LPC coefficient;

a prediction filter arranged on the basis of the LPC coefficient to obtain a prediction residual signal from the input signal;

pitch emphasis means for emphasizing the prediction residual signal in units of the pitch period;

a synthesis filter arranged on the basis of the LPC coefficient for forming an input signal emphasized in units of the pitch period from the prediction residual signal; and coding means for coding the input signal emphasized in units of the pitch period.

10. The coding apparatus according to claim 9, wherein said pitch emphasis means comprises pitch analysis means for obtaining a pitch period and a pitch gain at which the prediction residual signal has a minimum power, and a pitch emphasis circuit for emphasizing the prediction residual signal in units of the pitch period, using the pitch period and pitch gain.

11. The coding apparatus according to claim 10, wherein said pitch emphasis means emphasizes the input signal in units of the pitch period in accordance with the following equation to output a pitch emphasized signal;

$$b(n)=G\cdot a(n)+g\cdot\epsilon b(n-T)$$

where G: gain, g: pitch gain, $\epsilon<1$, T: pitch period.

12. A coding method comprising the steps of:

analyzing an input signal to detect a pitch period and a pitch gain;

emphasizing the input signal in units of the pitch period, using the pitch period and pitch gain; and coding the input signal emphasized in units of the pitch period.

13. A coding method comprising the steps of:

analyzing an input signal to obtain a LPC coefficient and a pitch period;

obtaining a prediction residual signal, using a prediction filter arranged on the basis of the LPC coefficient;

emphasizing the prediction residual signal in units of the pitch period to obtain a pitch-emphasized prediction residual signal;

forming an input signal emphasized in units of the pitch period from the pitch-emphasized prediction residual signal, using a synthesis filter arranged on the basis of the LPC coefficient; and coding the input signal emphasized in units of the pitch period.

* * * * *